US011163251B1

(12) United States Patent
Nishikata et al.

(10) Patent No.: US 11,163,251 B1
(45) Date of Patent: Nov. 2, 2021

(54) IMAGE FORMING APPARATUS

(71) Applicant: FUJI XEROX CO., LTD., Tokyo (JP)

(72) Inventors: Takumi Nishikata, Kanagawa (JP); Kazunobu Uchiyama, Kanagawa (JP); Eiichi Waida, Kanagawa (JP); Yusuke Chika, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/117,016

(22) Filed: Dec. 9, 2020

(30) Foreign Application Priority Data

May 27, 2020 (JP) ..... JP2020-092736

(51) Int. Cl.
*G03G 15/00* (2006.01)

(52) U.S. Cl.
CPC ..... *G03G 15/50* (2013.01); *G03G 15/6529* (2013.01)

(58) Field of Classification Search
CPC ..... G03G 15/50; G03G 15/5012; G03G 15/5075; G03G 15/5083; G03G 15/5087; G03G 2215/00016; G03G 2215/00021; G03G 2215/00113
See application file for complete search history.

(56) References Cited

U.S. PATENT DOCUMENTS 10,082,986 B2 9/2018 Wang
2012/0081715 A1* 4/2012 Takano ..... G03G 15/5062 358/1.5
2015/0043929 A1* 2/2015 Yagi ..... G03G 15/6585 399/38
2015/0063848 A1* 3/2015 Ikuta ..... B65H 5/062 399/45
2016/0202651 A1* 7/2016 Yamada ..... G03G 15/50 399/382
2016/0378041 A1* 12/2016 Kidera ..... G03G 15/6529 399/16

FOREIGN PATENT DOCUMENTS

JP 2018051857 4/2018
JP 2018205652 12/2018

* cited by examiner

*Primary Examiner* — Thomas S Giampaolo, II
(74) *Attorney, Agent, or Firm* — JCIPRNET

(57) ABSTRACT

An image forming apparatus including a first processor and a second processor are provided. When the two processors receive a cooperative command for forming images respectively at first and second image forming sections, the first processor transmits a preparation command for performing image formation preparation in the second image forming section to the second processor, and the second processor performs the image formation preparation in the second image forming section and transmits a completion notification to the first processor upon completion, and the first processor executes an image forming process. When the first processor receives an independent command for forming an image at the first image forming section but not at the second image forming section and subsequently receives the cooperative command, the first processor transmits the preparation command corresponding to the cooperative command to the second processor upon completion of an image forming process corresponding to the independent command.

7 Claims, 17 Drawing Sheets

FROM FIG. 6A

FROM FIG. 10A

IMAGE FORMING APPARATUS

CROSS-REFERENCE TO RELATED APPLICATIONS

This application is based on and claims priority under 35 USC 119 from Japanese Patent Application No. 2020-092736 filed May 27, 2020.

BACKGROUND

(i) Technical Field

The present disclosure relates to image forming apparatuses.

(ii) Related Art

In a technology proposed in the related art, two image forming sections form images on a single sheet.

For example, Japanese Unexamined Patent Application Publication No. 2018-205652 discloses an image forming system having the following configuration. Specifically, the image forming system includes a first image forming apparatus and a second image forming apparatus. The first image forming apparatus includes an image processing controller, a first controller, and an image forming section. The second image forming apparatus includes a second controller and an image forming section. When performing duplex printing, the image forming system feeds a sheet from a sheet feeder and causes the first image forming apparatus to perform printing on the front face of the sheet. Subsequently, the image forming system causes an inverting mechanism to invert the sheet, and transports the sheet to the second image forming apparatus. Then, the image forming system causes the second image forming apparatus to perform printing on the rear face of the sheet. After performing printing on the rear face of the sheet, the image forming system outputs the sheet to a paper output tray.

SUMMARY

For example, in a single image forming apparatus having a single housing, it is conceivable that the single housing contains therein two image forming sections that form images on a single sheet and two controllers that respectively control the two image forming sections, and that one of the controllers controls the transporting of the sheet. In such a configuration, when images are to be formed at the two image forming sections, the two controllers each receive a cooperative command as an image formation command given for forming images at the two image forming sections. In contrast, in a case of an independent command as an image formation command given for forming an image at one of the two image forming sections to be controlled by a first one of the controllers but not for forming an image at the other image forming section, it is conceivable that the first controller receives the independent command while the second controller does not receive the independent command. If the first controller receives a cooperative command after the independent command, the second controller receives the cooperative command alone without receiving the independent command. Therefore, there is a possibility that a single sheet undergoes an image forming process corresponding to the independent command executed by the first controller and an image forming process corresponding to the cooperative command executed by the second controller. In order to prevent this, it is desirable that the two image forming sections execute image forming processes corresponding to the same image formation command on the single sheet instead of executing image forming processes corresponding to different image formation commands on the single sheet.

Aspects of non-limiting embodiments of the present disclosure relate to an image forming apparatus in which two image forming sections are capable of executing image forming processes corresponding to the same image formation command on a single sheet.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a first processor configured to control a transporter that transports a sheet and a first image forming section that forms an image on the sheet transported by the transporter; and a second processor configured to control a second image forming section that forms an image on the sheet transported by the transporter. When the first processor and the second processor receive, from an external source, a cooperative command as an image formation command given for forming images at the first image forming section and the second image forming section, the first processor transmits a preparation command for performing image formation preparation in the second image forming section to the second processor, the second processor, when receiving the preparation command, performs the image formation preparation in the second image forming section and transmits a completion notification to the first processor upon completion of the image formation preparation, and the first processor, after receiving the completion notification, executes an image forming process involving causing the transporter to transport the sheet and causing the first image forming section to form the image. If the first processor receives an independent command as an image formation command given for forming an image at the first image forming section but not for forming an image at the second image forming section and subsequently receives the cooperative command, the first processor transmits the preparation command corresponding to the cooperative command to the second processor upon completion of an image forming process corresponding to the independent command.

BRIEF DESCRIPTION OF THE DRAWINGS

Exemplary embodiments of the present disclosure will be described in detail based on the following figures, wherein.

DETAILED DESCRIPTION

Exemplary embodiments of the disclosure will be described below with reference to the appended drawings.

First Exemplary Embodiment

Figure 1:
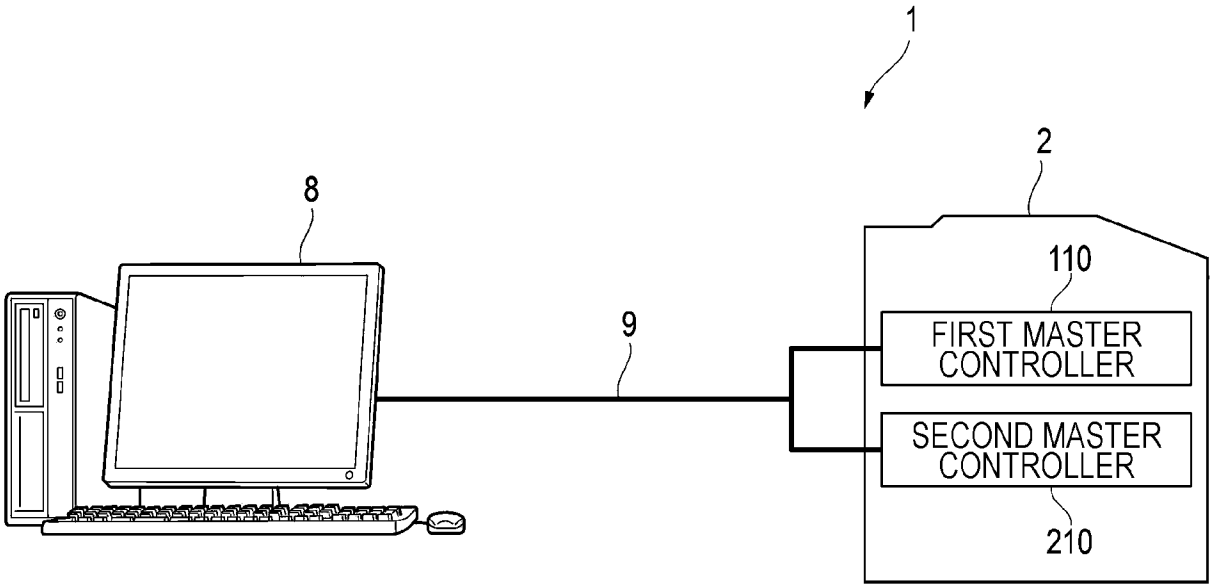
FIG. 1 schematically illustrates an example of an image forming system according to a first exemplary embodiment.

FIG. 1 schematically illustrates an example of an image forming system 1 according to a first exemplary embodiment.

Figure 2:
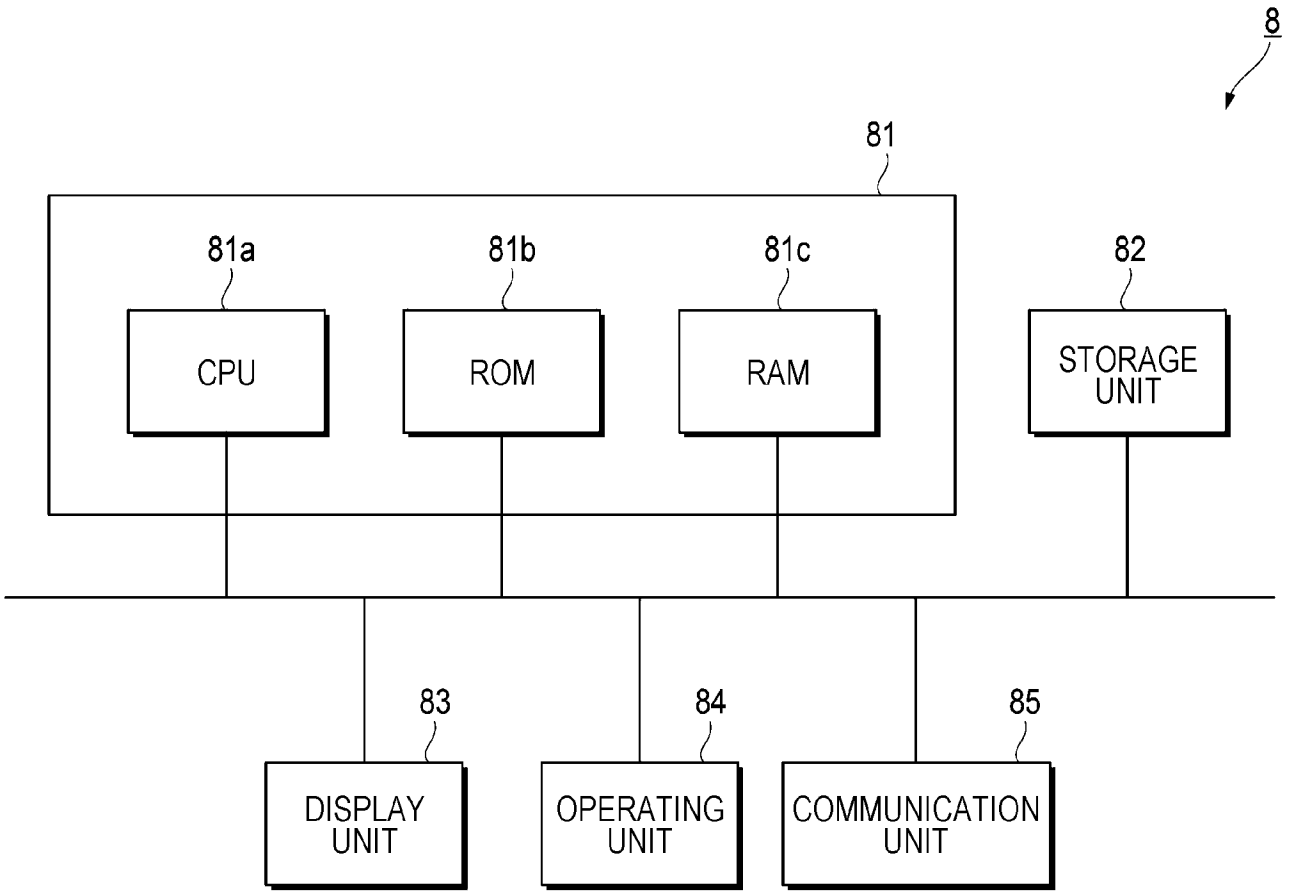
FIG. 2 illustrates an example of a hardware configuration of a terminal apparatus.

FIG. 2 illustrates an example of a hardware configuration of a terminal apparatus 8.

Figure 3:
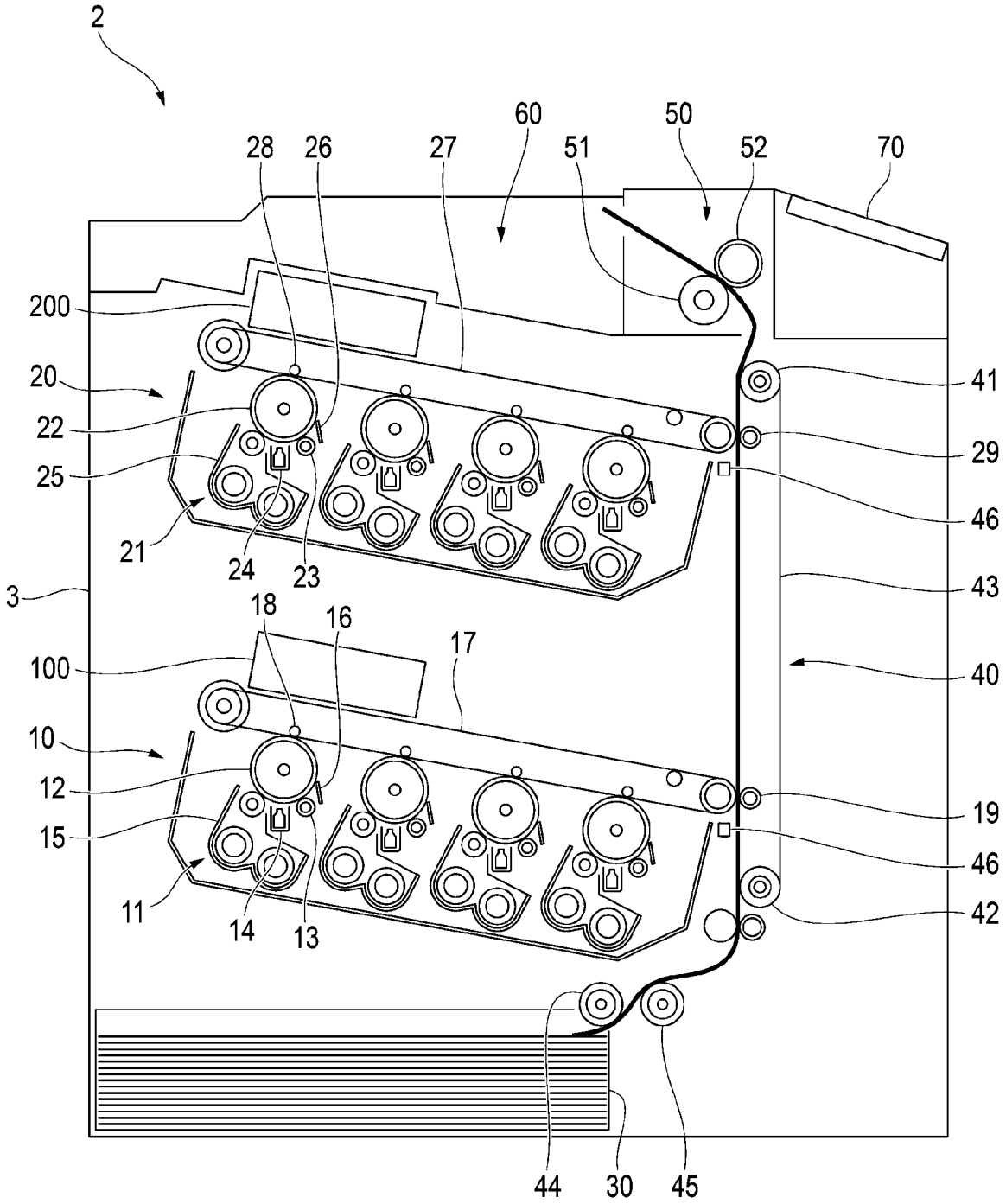
FIG. 3 schematically illustrates an example of an internal structure of an image forming apparatus.

FIG. 3 schematically illustrates an example of an internal structure of an image forming apparatus 2.

The image forming system 1 includes the image forming apparatus 2 and the terminal apparatus 8 connected to the image forming apparatus 2 by using a communication line 9. Although a single image forming apparatus 2 and a single terminal apparatus 8 are shown in FIG. 1, multiple image forming apparatuses 2 and multiple terminal apparatuses 8 may be provided.

The image forming apparatus 2 has a single housing 3 that contains therein a first image forming section 10 and a second image forming section 20 serving as two image forming sections that form images on a single sheet, a first controller 100 that controls the first image forming section 10, and a second controller 200 that controls the second image forming section 20. Furthermore, in the image forming apparatus 2, the first controller 100 controls a sheet transporter 40 that transports a sheet. The image forming apparatus 2 will be described in detail later.

Terminal Apparatus

The terminal apparatus 8 includes a controller 81 that controls the entire apparatus, a storage unit 82 used for storing data, a display unit 83 used for displaying an operation reception screen and an image, an operating unit 84 that receives an input operation from a user, and a communication unit 85 used for communicating with an external apparatus.

The controller 81 is constituted of a central processing unit (CPU) 81*a*, a read-only memory (ROM) 81*b*, and a random access memory (RAN) 81*c*. The ROM 81*b* stores therein a basic program (operating system) to be executed by the CPU 81*a*, as well as various settings. The CPU 81*a* uses the RAM 81*c* as a work area and executes, for example, application programs read from the ROM 81*b* and the storage unit 82. The CPU 81*a* executes the programs so as to control the components of the terminal apparatus 8.

An example of the storage unit 82 is a semiconductor memory. For example, the storage unit 82 stores therein an application program, such as a document creation application, a printer driver, and a spooler. For example, the document creation application generates a command for forming a document image on a sheet. The printer driver acquires the image formation command output from the document creation application and converts the image formation command into a command in a format analyzable by the image forming apparatus 2. The spooler temporarily stores the converted command output from the printer driver, waits until the image forming apparatus 2 completes an image forming process, and outputs a subsequent command.

In more detail, for example, after acquiring the image formation command output from the document creation application, the printer driver converts the image formation command into a command in a format analyzable by the first controller 100 and a command in a format analyzable by the second controller 200 in view of the characteristics of the first image forming section 10 and the second image forming section 20. Furthermore, the spooler outputs the command for the first controller 100 to the first controller 100, and outputs the command for the second controller 200 to the second controller 200. In the following description, the converted command output from the spooler may sometimes be referred to as "image formation command".

The display unit 83 displays, for example, still images and moving images. Examples of the display unit 83 include a liquid crystal display and an electroluminescence (EL) display.

The operating unit 84 is an input device that receives an operation from a user. Examples of the operating unit 84 include a button, a switch, and a touchscreen.

An example of the communication unit 85 is a communication interface.

Examples of the terminal apparatus 8 having the above-described configuration include a notebook personal computer (PC), a desktop PC, a tablet PC, a tablet terminal, a multifunction portable telephone (i.e., so-called "smartphone"), a portable telephone (i.e., so-called "feature phone"), and a portable information terminal (i.e., personal digital assistant (PDA)).

Image Forming Apparatus

The image forming apparatus 2 includes the first image forming section 10 that forms an image on a sheet as an example of a recording medium, and also includes the second image forming section 20 that forms an image on the sheet. The image forming apparatus 2 also includes a sheet retainer 30 that retains sheets and the sheet transporter 40 that transports each sheet retained in the sheet retainer 30 to, for example, the first image forming section 10. Moreover, the image forming apparatus 2 includes a fixing device 50 that applies heat and pressure onto a toner image formed on the sheet so as to fix the toner image onto the sheet, a sheet load section 60 on which the sheet having the image formed thereon as a result of the toner image being fixed thereon at the fixing device 50 is loaded, and a user interface (sometimes referred to as "UI" hereinafter) 70 that displays information. Furthermore, the image forming apparatus 2 includes the first controller 100 that controls the first image forming section 10, the sheet transporter 40, and the fixing device 50, and also includes the second controller 200 that controls the second image forming section 20.

The first image forming section 10 includes four image forming units 11 that are arranged parallel to one another at fixed intervals and that form toner images in the colors of toners contained therein. Each image forming unit 11 includes a photoconductor drum 12 that retains a toner image, a charging device 13 that electrostatically charges the surface of the photoconductor drum 12, and a light-emitting-diode (LED) print head 14 that exposes the photoconductor drum 12 electrostatically charged by the charging device 13 to light based on corresponding-color image data so as to form an electrostatic latent image on the photoconductor drum 12. Each image forming unit 11 further includes a developing device 15 that develops the electrostatic latent image formed on the photoconductor drum 12 and a drum cleaner 16 that cleans the photoconductor drum 12 after a transfer process. In the four image forming units 11 according to this exemplary embodiment, the developing devices 15 contain yellow (Y), magenta (M), cyan (C), and black (K) toners, respectively, and form toner images of the respective colors.

Furthermore, the first image forming section 10 includes an intermediate transfer belt 17 onto which the toner images of the respective colors formed on the photoconductor drums 12 of the individual image forming units 11 are superposed and transferred. Moreover, the first image forming section 10 includes first transfer rollers 18 that sequentially transfer (first-transfer) the toner images of the respective colors formed at the individual image forming units 11 onto the intermediate transfer belt 17, and also includes a second transfer roller 19 that collectively transfers (second-transfers) the toner images superposed and transferred on the intermediate transfer belt 17 onto the sheet.

Similar to the first image forming section 10, the second image forming section 20 includes four image forming units 21, an intermediate transfer belt 27, first transfer rollers 28, and a second transfer roller 29. Similar to the image forming units 11, the image forming units 21 each include a photoconductor drum 22, a charging device 23, an LED print head 24, a developing device 25, and a drum cleaner 26. In the four image forming units 21 according to this exemplary embodiment, the developing devices 25 contain therein white, gold, silver, and clear toners, respectively, and form toner images of the respective colors. The colors of the toners contained in the developing devices 25 of the image forming units 21 are not limited to the aforementioned colors. For example, the colors may alternatively be red, blue, and green.

The sheet transporter 40 includes an upper roller 41 and a lower roller 42 disposed apart from each other in the vertical direction, and also includes a transport belt 43 wrapped around the upper roller 41 and the lower roller 42. Furthermore, the sheet transporter 40 includes a feed roller 44 that feeds each sheet retained in the sheet retainer 30 toward the transport belt 43, and also includes a transport roller 45 disposed between the feed roller 44 and the transport belt 43. The sheet transporter 40 also includes multiple sensors 46 that detect the passing of a transported sheet.

The fixing device 50 includes a heating roller 51 that heats a transported sheet, and also includes a belt module 52 that is pressed against the heating roller 51 and that forms a pressure unit together with the heating roller 51. The fixing device 50 applies heat and pressure, at the pressure unit, onto a sheet having a toner image, so as to fix the toner image onto the sheet.

The UI 70 is, for example, a display panel that receives information from a user and that displays information to the user.

The image forming apparatus 2 having the above-described configuration operates as follows.

The toner images of the four colors formed on the photoconductor drums 12 in the image forming units 11 of the first image forming section 10 are first-transferred onto the intermediate transfer belt 17 by the first-transfer rollers 18, so that a superposed toner image constituted of the superposed toners of the four colors is formed on the intermediate transfer belt 17. Then, as the intermediate transfer belt 17 moves, the superposed toner image on the intermediate transfer belt 17 is transported to a second-transfer unit where the second-transfer roller 19 is disposed.

When the superposed toner image in the first image forming section 10 is transported to the second-transfer unit, a sheet is fed from the sheet container 30 to the second-transfer unit in accordance with this timing. Then, at the second-transfer unit, the superposed toner image is collectively second-transferred onto the transported sheet in accordance with a transfer electric field produced by the second-transfer roller 19.

The toner images of the remaining four colors formed on the photoconductor drums 22 in the image forming units 21 of the second image forming section 20 are first-transferred onto the intermediate transfer belt 27 by the first-transfer rollers 28, so that a superposed toner image constituted of the superposed toners of the remaining four colors is formed on the intermediate transfer belt 27. Then, as the intermediate transfer belt 27 moves, the superposed toner image on the intermediate transfer belt 27 is transported to a second-transfer unit where the second-transfer roller 29 is disposed.

When the superposed toner image in the second image forming section 20 is transported to the second-transfer unit, the sheet having the superposed toner image electrostatically transferred thereon at the first image forming section 10 is fed to this second-transfer unit in accordance with this timing. Then, at the second-transfer unit, the superposed toner image in the second image forming section 20 is collectively second-transferred onto the superposed toner image on the transported sheet, having the superposed toner image electrostatically transferred thereon at the first image forming section 10, in accordance with a transfer electric field produced by the second-transfer roller 29.

Subsequently, the sheet having electrostatically transferred thereon a superposed toner image constituted of the superposed toner image in the first image forming section 10 and the superposed toner image in the second image forming section 20 is transported to the fixing device 50. The toner image on the sheet transported to the fixing device 50 receives heat and pressure applied by the fixing device 50, so as to be fixed onto the sheet. Then, the sheet having the fixed image thereon is transported to the sheet load section 60 of the image forming apparatus 2.

Figure 4:
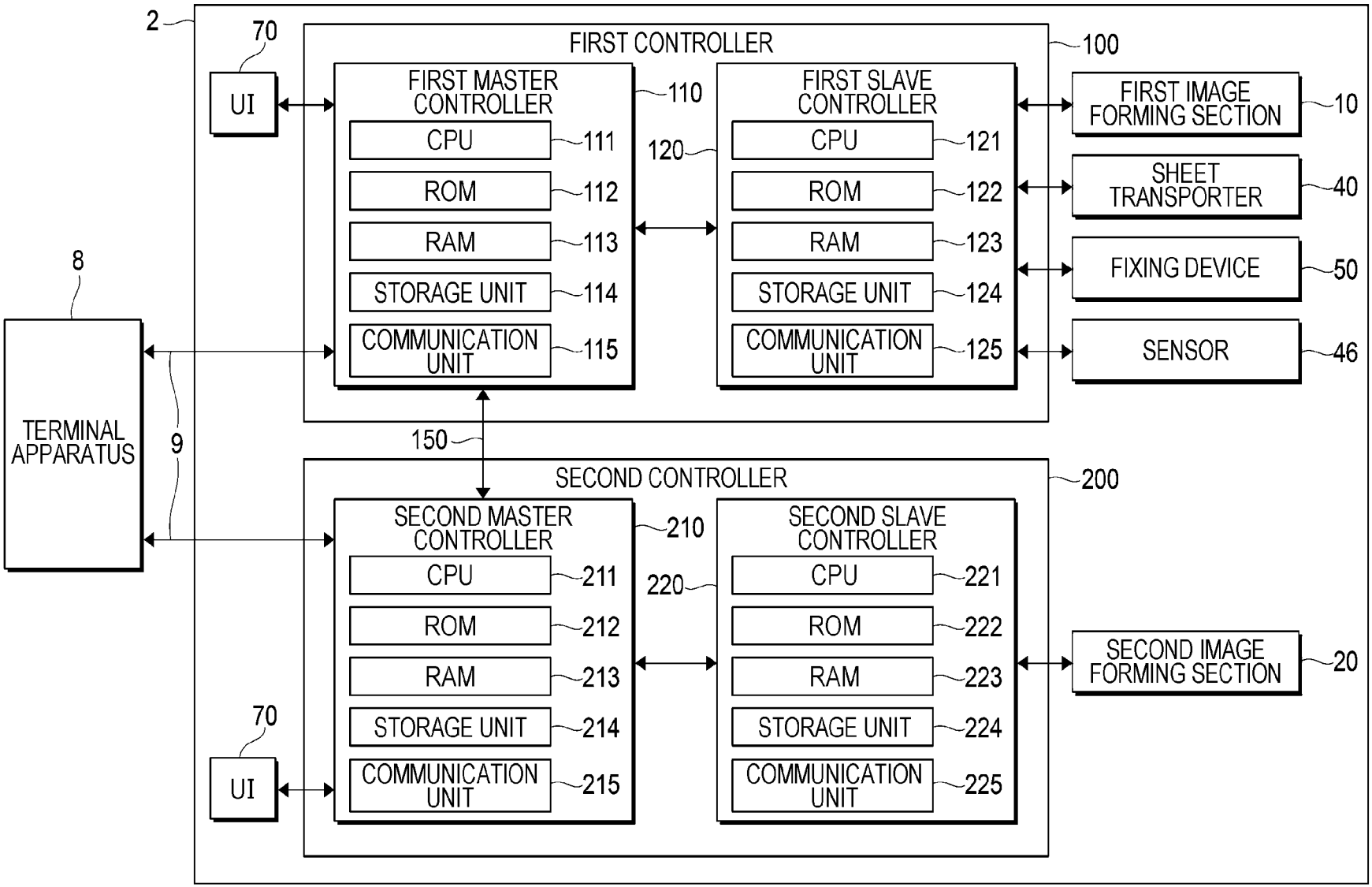
FIG. 4 is a block diagram illustrating an example of a hardware configuration of a first controller and a second controller.

FIG. 4 is a block diagram illustrating an example of a hardware configuration of the first controller 100 and the second controller 200.

First Controller 100

The first controller 100 includes a first master controller 110 that controls the operation of, for example, the first image forming section 10, the sheet transporter 40, and the fixing device 50, and also includes a first slave controller 120 that controls the operation of these devices under the control of the first master controller 110.

The first master controller 110 includes a central processing unit (CPU) 111, a read-only memory (ROM) 112, a random access memory (RAN) 113, a storage unit 114, such as a semiconductor memory, and a communication unit 115 used for communicating with an external apparatus. An example of the communication unit 115 is a communication interface (I/F).

The ROM 112 stores therein a basic program (operating system) to be executed by the CPU 111, as well as various settings. The CPU 111 uses the RAM 113 as a work area and executes programs read from the ROM 112 and the storage unit 114. The CPU 111 executes the programs so that functions of the first master controller 110 to be described below are realized.

The first master controller 110 exchanges information with the first slave controller 120, the second controller 200, and the UI 70 via the communication unit 115.

Furthermore, the first master controller 110 receives an image formation command from an external source, such as the terminal apparatus 8, via the communication unit 115. The first master controller 110 analyzes the received image formation command. The image formation command contains image data as data of an image to be formed, as well as designated image formation settings. Examples of the image formation settings include the size and the material of a sheet on which the image is to be formed, and the colors of colorants to be used.

The first master controller 110 also performs predetermined image processing on the received image data. The first master controller 110 converts the image data into YMCK data with respect to the reproduction colors of the first image forming section 10, that is, the colors (yellow (Y), magenta (M), cyan (C), and black (K)) of the toners serving as the colorants of the first image forming section 10, and outputs the YMCK data. The YMCK data is constituted of Y-color data, M-color data, C-color data, and K-color data that are separated from one another for the individual colors.

Furthermore, the first master controller 110 notifies the first slave controller 120 of the size and the material of the sheet according to the received image formation command.

Similar to the first master controller 110, the first slave controller 120 includes a CPU 121, a ROM 122, a RAM 123, a storage unit 124, and a communication unit 125. The CPU 121 uses the RAM 123 as a work area and executes programs read from the ROM 122 and the storage unit 124, so that functions of the first slave controller 120 to be described below are realized.

The first slave controller 120 exchanges control information with the first master controller 110 so as to perform control of, for example, exposure, development, and transfer processes in the first image forming section 10, sheet feed and transport processes by the sheet transporter 40 in accordance with a transfer timing, and a toner-image fixing process by the fixing device 50.

Furthermore, the first slave controller 120 acquires information about an error, such as a toner shortage in the first image forming section 10 or a paper jam in the sheet transporter 40. The first slave controller 120 notifies the first master controller 110 of this error information. The first master controller 110 notifies the user of this error information by displaying the error information on the display panel of the UI 70. Then, for example, if the error is a toner shortage, the first slave controller 120 acquires information indicating that the error has been resolved when the toner is resupplied. If the error is a paper jam, for example, the first slave controller 120 acquires information indicating that the error has been resolved when the paper jam is removed. Then, the first slave controller 120 notifies the first master controller 110 that the error has been resolved. The first master controller 110 notifies the user that the error has been resolved by displaying a message on the display panel of the UI 70.

Second Controller 200

The second controller 200 includes a second master controller 210 that controls the operation of the second image forming section 20, and also includes a second slave controller 220 that controls the operation of the second image forming section 20 under the control of the second master controller 210. The second master controller 210 exchanges information with the first master controller 110 via a connection line 150.

The second master controller 210 includes a CPU 211, a ROM 212, a RAM 213, a storage unit 214, such as a semiconductor memory, and a communication unit 215 used for communicating with an external apparatus.

The ROM 212 stores therein a basic program (operating system) to be executed by the CPU 211, as well as various settings. The CPU 211 uses the RAM 213 as a work area and executes programs read from the ROM 212 and the storage unit 214. The CPU 211 executes the programs so that functions of the second master controller 210 to be described below are realized.

The second master controller 210 exchanges information with the second slave controller 220, the first controller 100, and the UI 70 via the communication unit 215.

Furthermore, the second master controller 210 receives an image formation command from, for example, a user terminal (such as a PC) via the communication unit 215. The second master controller 210 analyzes the received image formation command. The image formation command contains image data as data of an image to be formed, as well as designated image formation settings.

The second master controller 210 also performs predetermined image processing on the received image data. The second master controller 210 converts the image data into white-color data, gold-color data, silver-color data, and clear data with respect to the reproduction colors of the second image forming section 20, that is, the colors (white, gold, silver, and clear) of the toners serving as the colorants of the second image forming section 20, and outputs the white-color data, the gold-color data, the silver-color data, and the clear data.

Moreover, the second master controller 210 notifies the second slave controller 220 of the size and the material of the sheet according to the received image formation command.

The second slave controller 220 includes a CPU 221, a ROM 222, a RAM 223, a storage unit 224, and a communication unit 225. The CPU 221 uses the RAM 223 as a work area and executes programs read from the ROM 222 and the storage unit 224, so that functions of the second slave controller 220 to be described below are realized.

The second slave controller 220 exchanges control information with the second master controller 210 so as to perform control of, for example, exposure, development, and transfer processes in the second image forming section 20.

Furthermore, the second slave controller 220 acquires information about an error, such as a toner shortage in the second image forming section 20. The second slave controller 220 notifies the second master controller 210 of this error information. The second master controller 210 notifies the user of this error information by displaying the error information on the display panel of the UI 70. Then, for example, if the error is a toner shortage, the second slave controller 220 acquires information indicating that the error has been resolved when the toner is resupplied. Then, the second slave controller 220 notifies the second master controller 210 that the error has been resolved. The second master controller 210 notifies the user that the error has been resolved by displaying a message on the display panel of the UI 70.

Collaborative Operation Between First Controller 100 and Second Controller 200

The first controller 100 and the second controller 200 exchange information with each other after activation, cause the first image forming section 10 to second-transfer the four-color superposed toner image onto a sheet transported by the sheet transporter 40 operating under the control of the first controller 100, and cause the second image forming section 20 to second-transfer the other four-color superposed toner image onto the sheet. The expression "the first image forming section 10 second-transfers the four-color superposed toner image onto the sheet" may sometimes be expressed as "the first image forming section 10 forms an image" hereinafter. The expression "the second image forming section 20 second-transfers the other four-color superposed toner image onto the sheet" may sometimes be expressed as "the second image forming section 20 forms an image" hereinafter.

The process performed by the first controller 100 and the second controller 200 will be described below.

For example, after acquiring an image formation command output from the document creation application, if the command is given for forming images at the first image forming section 10 and the second image forming section 20, the printer driver in the terminal apparatus 8 converts the command into a command for the first master controller 110 and the second master controller 210. Then, the spooler outputs the command to each of the first master controller 110 and the second master controller 210. In this manner, the terminal apparatus 8 transmits an image formation command to each of the first master controller 110 and the second master controller 210. An image formation command given for forming images at the first image forming section 10 and the second image forming section 20 may sometimes be referred to as "cooperative command" hereinafter. The terminal apparatus 8 transmits a cooperative command to each of the first master controller 110 and the second master controller 210.

On the other hand, for example, if a command output from the document creation application is given for forming an image at the first image forming section 10 but not for forming an image at the second image forming section 20, the printer driver of the terminal apparatus 8 converts the command into a command for the first master controller 110. For example, this corresponds to a case where the command is given for forming an image using the toners in the first image forming section 10 without using the toners in the second image forming section 20 or a case where a user designates an image forming process at the first image forming section 10 alone from the terminal apparatus 8 via the printer driver. Then, the spooler outputs the command to the first master controller 110. Accordingly, the terminal apparatus 8 transmits an image formation command to the first master controller 110. An image formation command given for forming an image at the first image forming section 10 but not for forming an image at the second image forming section 20 may sometimes be referred to as "independent command" hereinafter. The terminal apparatus 8 transmits an independent command only to the first master controller 110. The terminal apparatus 8 causes the independent command to contain information indicating that an image is to be formed at the first image forming section 10 but an image is not to be formed at the second image forming section 20.

Figure 5A:
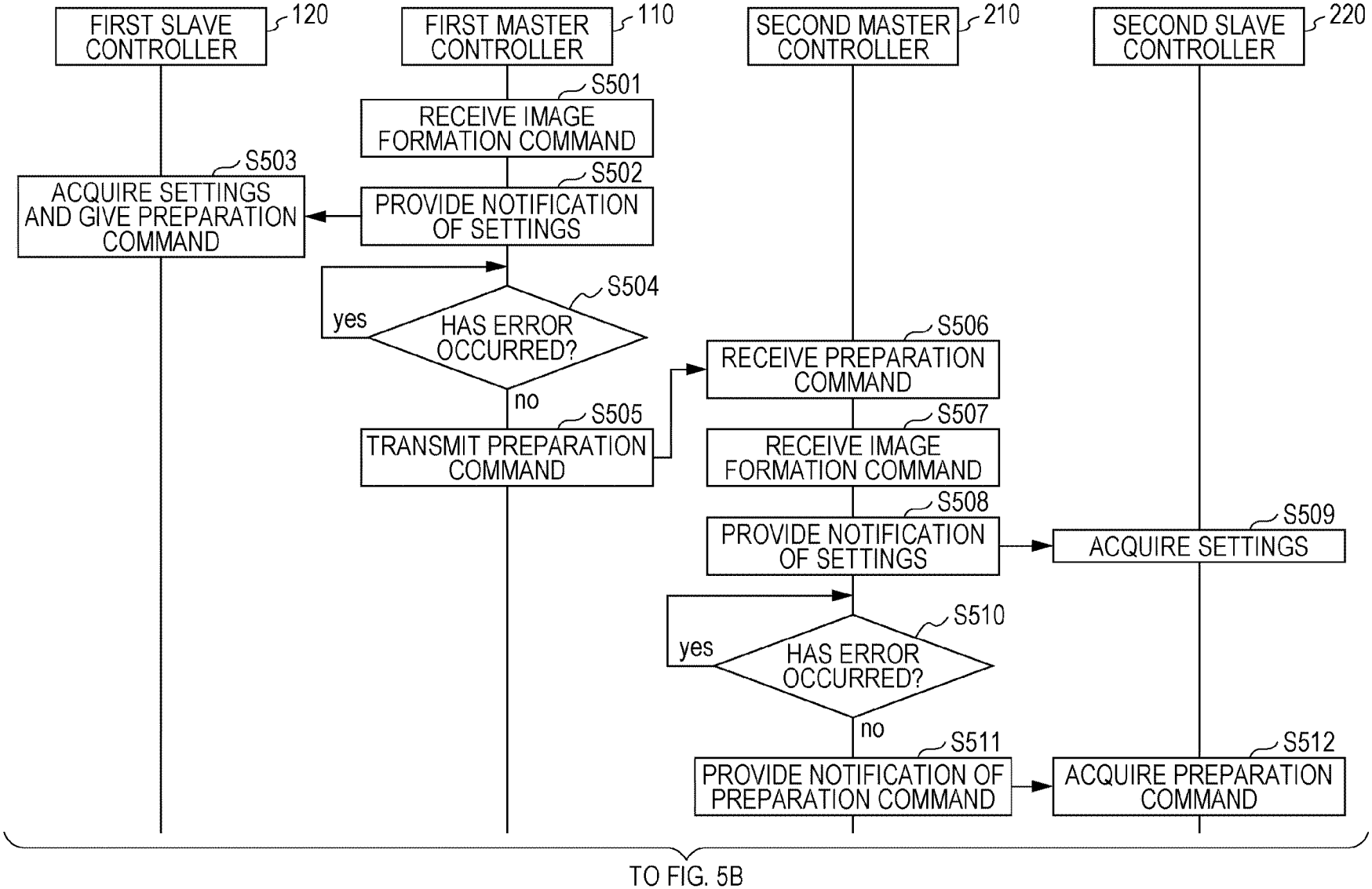
FIGS. 5A and 5B illustrate an example of a process performed by the first controller and the second controller.
Figure 5B:
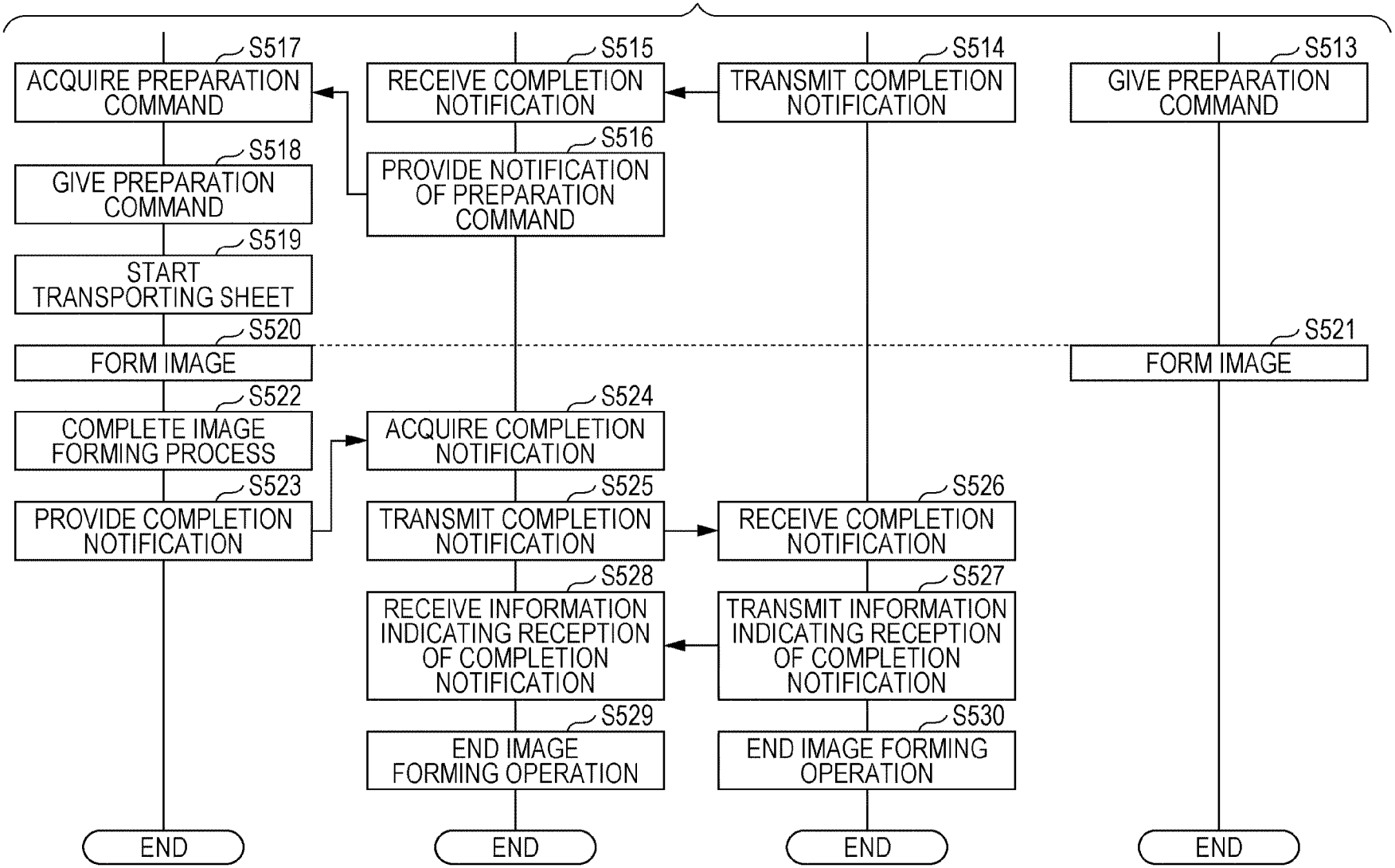

FIGS. 5A and 5B illustrate an example of the process performed by the first controller 100 and the second controller 200. The process shown in FIGS. 5A and 5B corresponds to a case where a cooperative command is received by the first controller 100 and the second controller 200.

When the first master controller 110 receives an image formation command from, for example, the terminal apparatus 8 via the communication unit 115 in step S501, the first master controller 110 notifies the first slave controller 120 of designated image formation settings in step S502. Consequently, in step S503, the first slave controller 120 acquires the image formation settings and gives a command for image formation preparation. Image formation preparation involves, for example, preparing the sheet transporter 40 to make it capable of transporting a sheet (sometimes referred to as "transport preparation" hereinafter), and includes activation of a motor that rotates various types of rollers, such as the feed roller 44. Another example of image formation preparation involves preparing the fixing device 50 to make it fix a toner image onto a sheet, and includes increasing the temperature of the heating roller 51.

Subsequently, the first master controller 110 determines in step S504 whether or not an error, such as a toner shortage or a paper jam, has occurred in the first image forming section 10. If an error has not occurred (NO in step S504), the first master controller 110 transmits, to the second master controller 210, a preparation command for performing image formation preparation in the second image forming section 20 in step S505. If an error has occurred (YES in step S504), the first master controller 110 waits until the error is resolved.

In step S506, the second master controller 210 receives the preparation command transmitted from the first master controller 110. Then, if the image formation command is received from, for example, the terminal apparatus 8 via the communication unit 215 in step S507, the second master controller 210 notifies the second slave controller 220 of the image formation settings in step S508. Consequently, the second slave controller 220 acquires the image formation settings in step S509. Alternatively, the reception of the image formation command in step S507 may be performed prior to the reception of the preparation command from the first master controller 110 in step S506.

Subsequently, the second master controller 210 determines in step S510 whether or not an error, such as a toner shortage, has occurred in the second image forming section 20. If an error has not occurred (NO in step S510), the second master controller 210 notifies the second slave controller 220 of the preparation command for performing image formation preparation in the second image forming section 20 in step S511. After acquiring the preparation command in step S512, the second slave controller 220 commands the second image forming section 20 to perform image formation preparation in step S513. Image formation preparation involves performing preparation when an image forming section is to form an image, and includes, for example, a warm-up process of the developing devices 25, an image-quality adjustment process, and a process for spontaneously disposing deteriorated toners. All of these processes consume electric power and some may consume toner. When the image formation preparation is completed, the second image forming section 20 is set on standby. In contrast, if an error has occurred (YES in step S510), the second master controller 210 waits until the error is resolved.

When the image formation preparation in the second image forming section 20 is completed, the second master controller 210 transmits a completion notification indicating that the preparation is completed to the first master controller 110 in step S514. Alternatively, after the second slave controller 220 gives the command for image formation preparation in step S513, the second master controller 210 may determine that the image formation preparation in the second image forming section 20 is completed when the second master controller 210 receives a notification indicating that the preparation is completed from the second image forming section 20. As another alternative, after the second slave controller 220 gives the command for image formation preparation in step S513, the second master controller 210 may determine that the image formation preparation in the second image forming section 20 is completed when a predetermined period elapses.

After receiving the completion notification from the second master controller 210 in step S515, the first master controller 110 notifies the first slave controller 120 of the preparation command for performing image formation preparation in the first image forming section 10 in step S516. After acquiring the preparation command in step S517, the first slave controller 120 commands the first image forming section 10 to perform image formation preparation in step S518. Image formation preparation includes, for example, a warm-up process of the developing devices 15, an image-quality adjustment process, and a process for spontaneously disposing deteriorated toners. When the image formation preparation is completed, the first image forming section 10 is set on standby.

When the image formation preparation in the first image forming section 10 is completed, the first slave controller 120 causes the sheet transporter 40 to start transporting a sheet in step S519, and causes the first image forming section 10 to form an image on the transported sheet in step S520. Alternatively, after giving the command for image formation preparation in step S516, the first master controller 110 may determine that the image formation preparation in the first image forming section 10 is completed when the first master controller 110 receives a notification indicating that the preparation is completed from the first image forming section 10. As another alternative, after giving the command for image formation preparation in step S516, the first master controller 110 may determine that the image formation preparation in the first image forming section 10 is completed when a predetermined period elapses.

In step S521, the second slave controller 220 causes the second image forming section 20 to form an image on the transported sheet.

Then, the first slave controller 120 causes the fixing device 50 to fix the toner image on the transported sheet onto the sheet and to output the sheet having undergone the fixing process onto the sheet load section 60, and completes the image forming process in step S522.

In step S523, the first slave controller 120 notifies the first master controller 110 that the image forming process is completed. After acquiring the completion notification in step S524, the first master controller 110 transmits the completion notification indicating that the image forming process is completed to the second master controller 210 in step S525.

After receiving the completion notification in step S526, the second master controller 210 transmits information indicating the reception of the completion notification to the first master controller 110 in step S527.

After receiving the information indicating the reception of the completion notification in step S528, the first master controller 110 ends the image forming operation in step S529. The end of the image forming operation includes an end of the toner-image forming process in the first image forming section 10 and a process for deleting current-image-formation-related information stored in the RAM 113 and the storage unit 114.

After transmitting the information indicating the reception of the completion notification to the first master controller 110 in step S527, the second master controller 210 ends the image forming operation in step S530. The end of the image forming operation includes an end of the toner-image forming process in the second image forming section 20 and a process for deleting current-image-formation-related information stored in the RAM 213 and the storage unit 214.

Accordingly, in this exemplary embodiment, the image forming operation is performed by causing the first controller 100 and the second controller 200 to operate collaboratively with each other.

For example, if an error has not occurred in the first image forming section 10 or the sheet transporter 40, serving as a target to be controlled by the first master controller 110, the first master controller 110 transmits, to the second master controller 210 in step S505, a preparation command for performing image formation preparation in the second image forming section 20. After receiving this preparation command in step S506, the second master controller 210 notifies the second slave controller 220 of the preparation command for performing image formation preparation in the second image forming section 20 in step S511 if an error has not occurred in the second image forming section 20 serving as a target to be controlled by the second master controller 210. When the image formation preparation in the second image forming section 20 is completed, the second master controller 210 transmits a completion notification indicating that the preparation is completed to the first master controller 110 in step S514. After receiving the completion notification in step S515, the first master controller 110 notifies the first slave controller 120 of the preparation command for performing image formation preparation in the first image forming section 10 in step S516.

Accordingly, a time lag between the timing at which the first image forming section 10 starts to form an image and the timing at which the second image forming section 20 starts to form an image may be suppressed. This time lag may be caused when, for example, the first controller 100 and the second controller 200 operate independently of each other instead of collaboratively with each other. For example, a situation where an image forming process by the second image forming section 20 is not performed in time may be suppressed. Such a situation may occur when a sheet transport process is started by the sheet transporter 40 or an image forming process is started by the first image forming section 10 regardless of the fact that the image formation preparation in the second image forming section 20 is not completed.

Moreover, a situation where electric power is wastefully consumed due to the second image forming section 20 being on standby for a long period of time regardless of the fact that an error has occurred in the first image forming section 10 or the sheet transporter 40 may be suppressed. Furthermore, a situation where electric power is wastefully consumed due to the first image forming section 10 being on standby for a long period of time regardless of the fact that an error has occurred in the second image forming section 20 may be suppressed.

In this exemplary embodiment, when an image forming process is completed, the first master controller 110 transmits, to the second master controller 210 in step S525, a completion notification indicating that the image forming process is completed. Then, after receiving the completion notification in step S526, the second master controller 210 transmits information indicating the reception of the completion notification to the first master controller 110 in step S527.

Consequently, a situation where the second controller 200 is not able to ascertain that the fixing process by the fixing device 50 is completed and that the image forming process is completed due to the first controller 100 and the second controller 200 operating independently of each other may be suppressed.

The following description relates to a process performed when the first master controller 110 receives an independent command and subsequently receives a cooperative command from an external source.

When the first master controller 110 according to the first exemplary embodiment receives an independent command and subsequently receives a cooperative command, the first master controller 110 performs an image forming process corresponding to the independent command and transmits a preparation command corresponding to the cooperative command to the second master controller 210 upon completion of the image forming process corresponding to the independent command.

When the second master controller 210 according to the first exemplary embodiment receives the preparation command corresponding to the cooperative command, the second master controller 210 performs image formation preparation in the second image forming section 20 and transmits a completion notification to the first master controller 110 upon completion of the image formation preparation.

After receiving the completion notification, the first master controller 110 executes an image forming process corresponding to the cooperative command.

An example of the process will be described below in further detail.

Figure 6A:
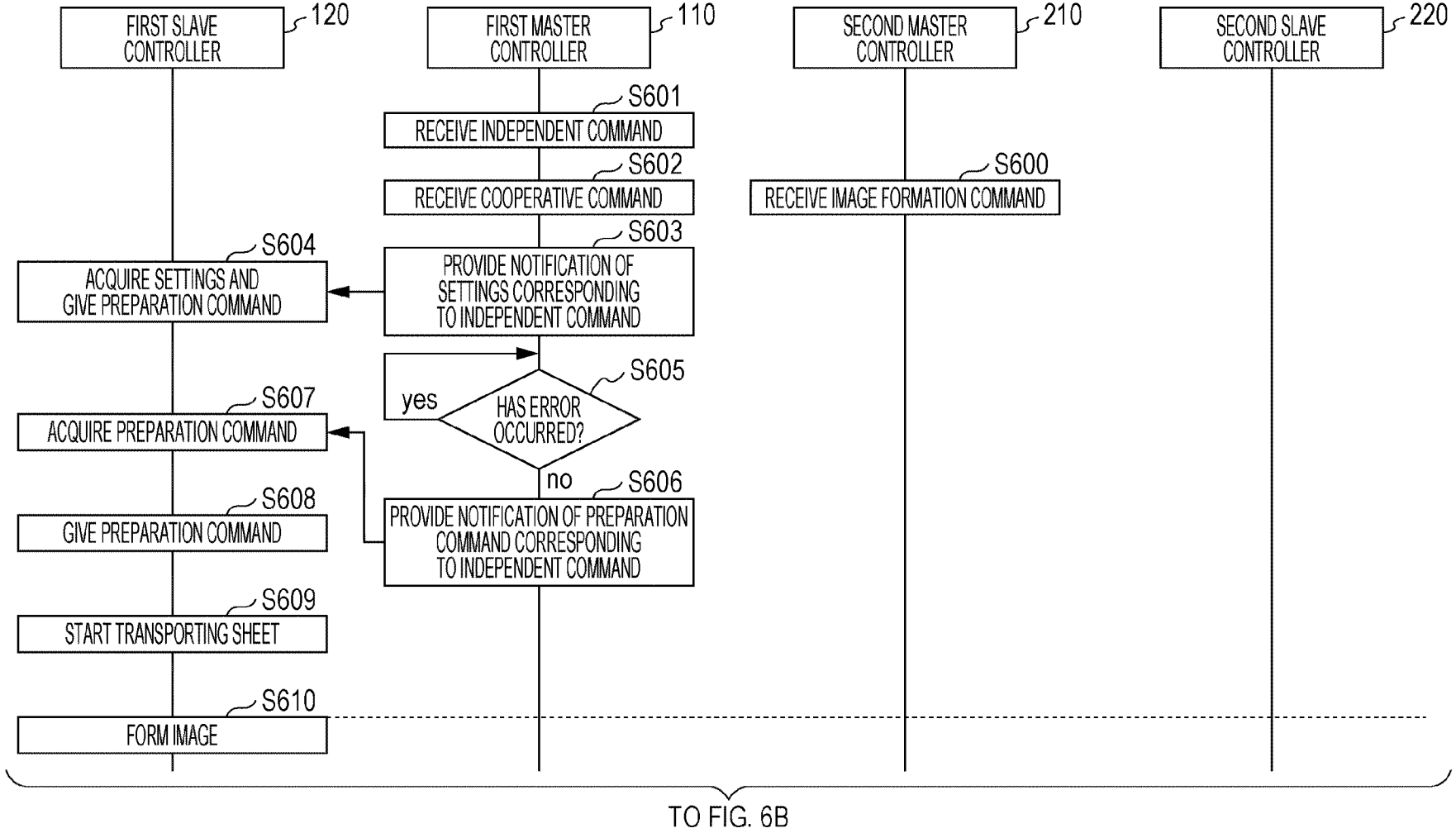
FIGS. 6A and 6B illustrate an example of a process performed by the first controller and the second controller when a first master controller receives a cooperative command after an independent command.
Figure 6B:
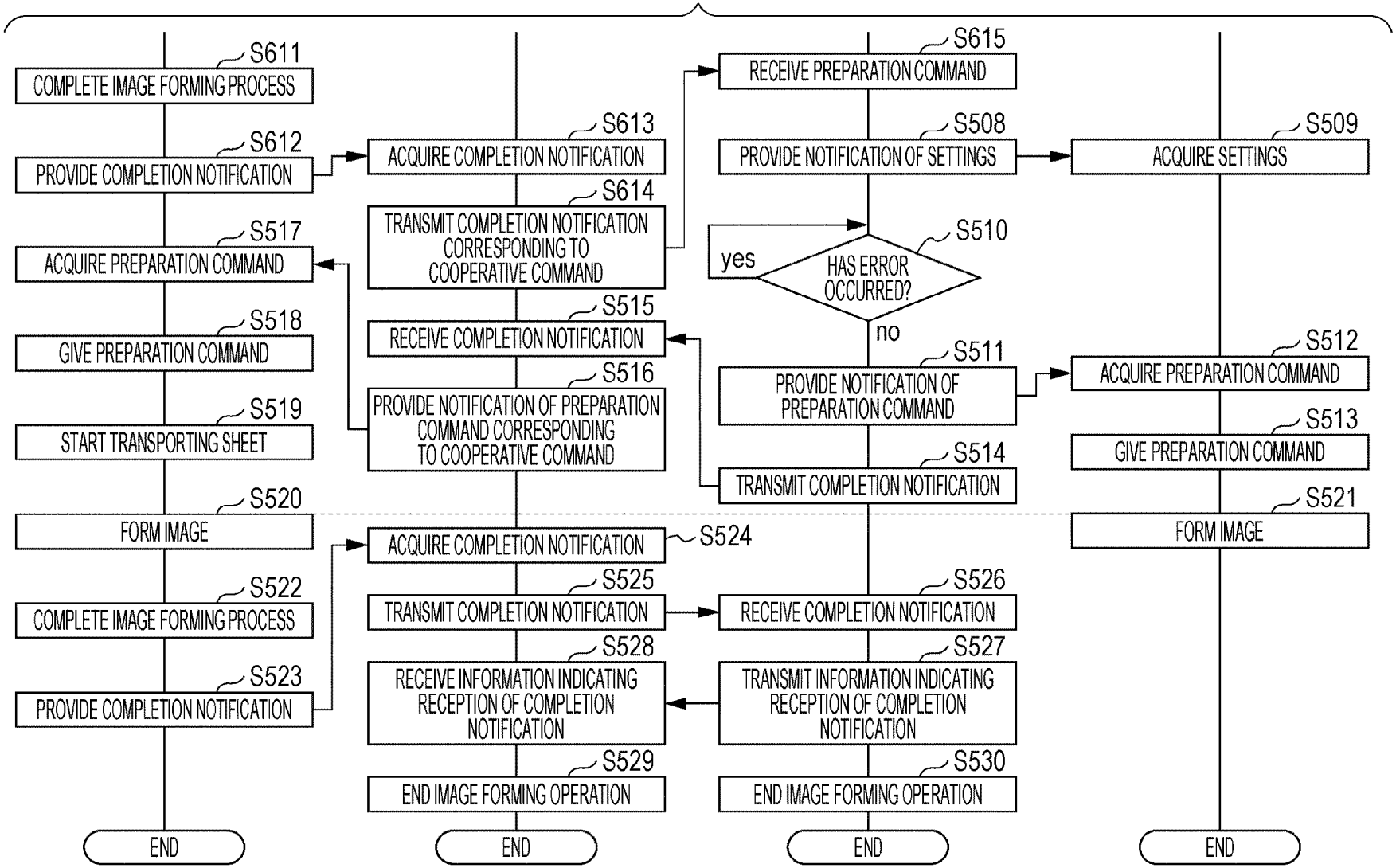

FIGS. 6A and 6B illustrate the example of the process performed by the first controller 100 and the second controller 200 when the first master controller 110 receives an independent command and subsequently receives a cooperative command. FIGS. 6A and 6B correspond to a case where the first master controller 110 receives the cooperative command before notifying the first slave controller 120 of the image formation settings corresponding to the independent command (step S502). Steps identical to the steps shown in FIGS. 5A and 5B are given the same reference signs, and descriptions thereof will be omitted. It is assumed that the second master controller 210 has received the cooperative command in step S600 from, for example, the terminal apparatus 8 via the communication unit 215.

In a case where the first master controller 110 receives an independent command in step S601 and subsequently receives a cooperative command in step S602, the first master controller 110 notifies the first slave controller 120 of the image formation settings corresponding to the independent command in step S603. Accordingly, the first slave controller 120 acquires the image formation settings corresponding to the independent command and gives a command for image formation preparation in step S604. Then, the first master controller 110 determines in step S605 whether or not an error has occurred. If an error has occurred (YES in step S605), the first master controller 110 waits until the error is resolved. In contrast, if an error has not occurred (NO in step S605), the first master controller 110 notifies the first slave controller 120 of the preparation command, corresponding to the independent command, for performing image formation preparation in the first image forming section 10 in step S606.

The first slave controller 120 acquires the preparation command in step S607 and commands the first image forming section 10 to perform image formation preparation in step S608. When the image formation preparation in the first image forming section 10 is completed, the first slave controller 120 causes the sheet transporter 40 to transport a sheet in step S609 and causes the first image forming section 10 to form an image on the transported sheet in step S610. Then, the first slave controller 120 causes the fixing device 50 to fix the toner image on the transported sheet onto the sheet and to output the sheet having undergone the fixing process onto the sheet load section 60, and completes the image forming process in step S611. Subsequently, in step S612, the first slave controller 120 notifies the first master controller 110 that the image forming process is completed.

After acquiring the completion notification in step S613, the first master controller 110 transmits a preparation command, corresponding to the cooperative command, for performing image formation preparation in the second image forming section 20 to the second master controller 210 in step S614.

In step S615, the second master controller 210 receives the preparation command corresponding to the cooperative command transmitted from the first master controller 110. Since the subsequent steps are identical to the steps from step S508 and onward described above with reference to FIGS. 5A and 5B, the steps identical to the steps shown in FIGS. 5A and 5B will be given the same reference signs, and descriptions thereof will be omitted.

A process performed by the first master controller 110 according to the first exemplary embodiment will be described below with reference to flowcharts.

Figure 7:
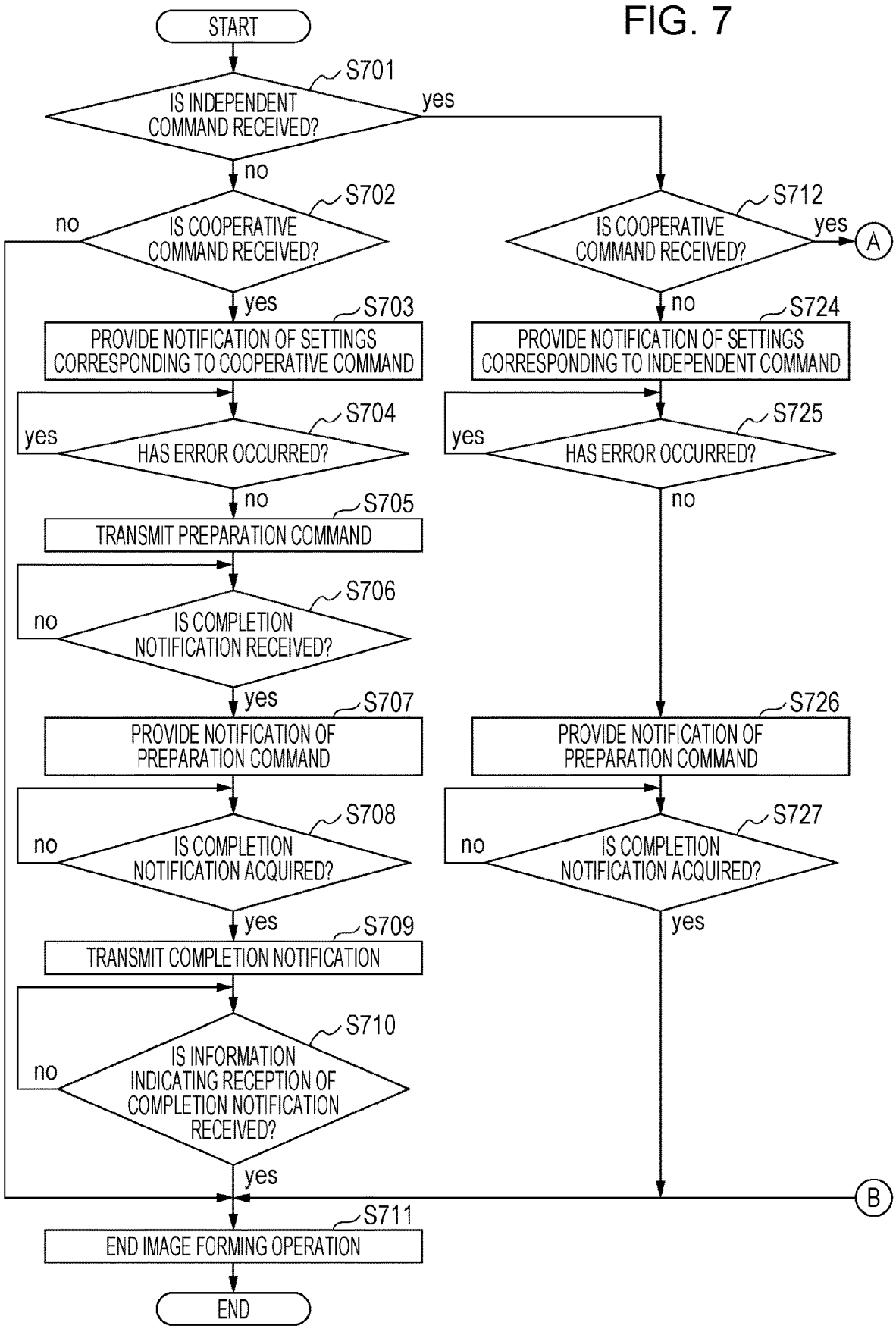
FIG. 7 is a flowchart illustrating an example of a process performed by the first master controller according to the first exemplary embodiment.
Figure 8:
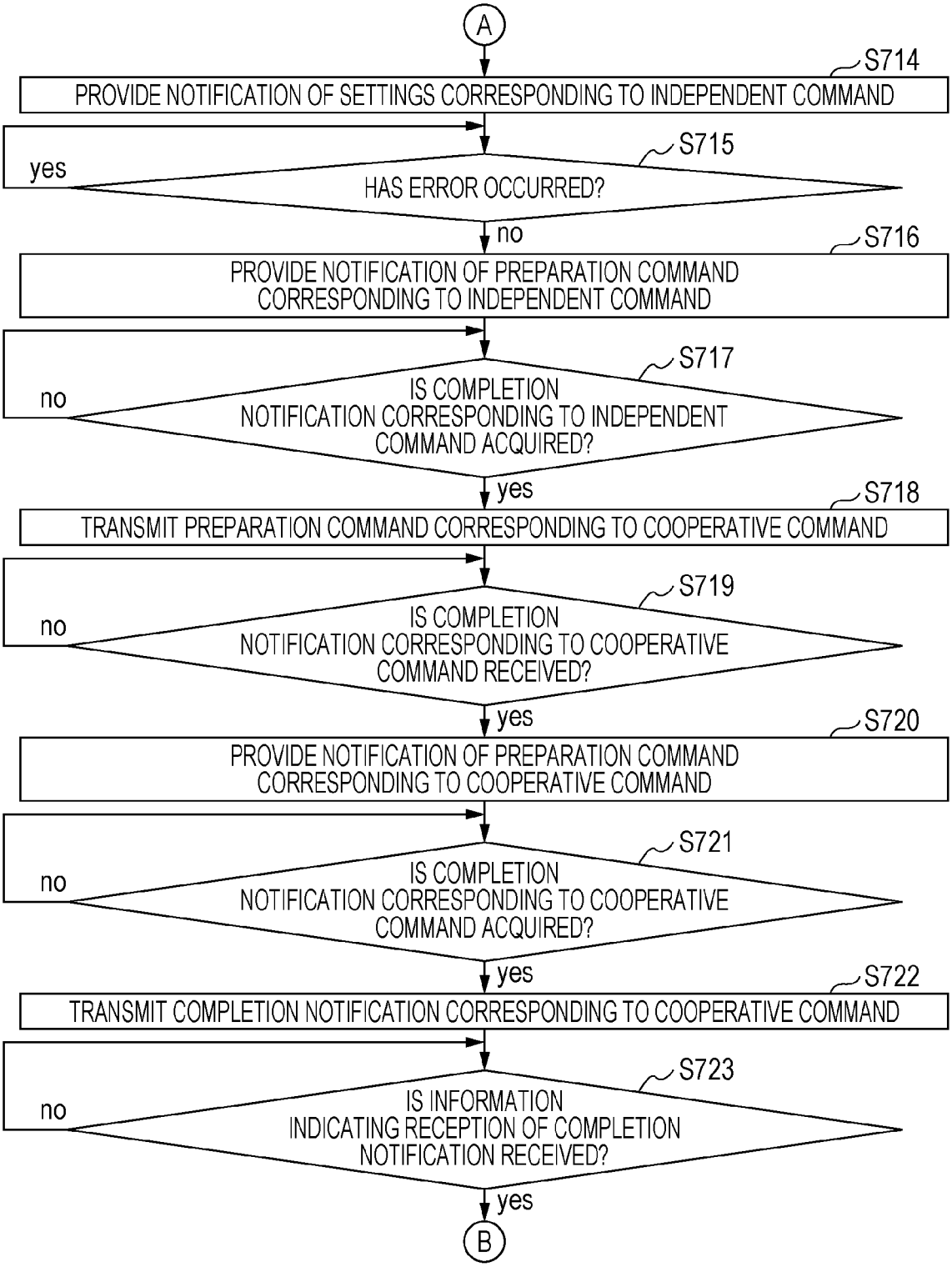
FIG. 8 is a flowchart illustrating the example of the process performed by the first master controller according to the first exemplary embodiment.

FIGS. 7 and 8 are flowcharts illustrating an example of the process performed by the first master controller 110 according to the first exemplary embodiment. The first master controller 110 repeatedly performs this process at every predetermined fixed time period (e.g., 1 millisecond).

In step S701, the first master controller 110 determines whether or not an independent command is received from, for example, the terminal apparatus 8. If an independent command is not received (NO in step S701), the first master controller 110 determines in step S702 whether or not a cooperative command is received from, for example, the terminal apparatus 8. If a cooperative command is received (YES in step S702), the first master controller 110 notifies the first slave controller 120 of the image formation settings corresponding to the cooperative command in step S703.

After providing the notification about the image formation settings in step S703, the first master controller 110 determines in step S704 whether or not an error has occurred. If an error has not occurred (NO in step S704), the first master controller 110 transmits a preparation command for performing image formation preparation in the second image forming section 20 to the second master controller 210 in step S705. In contrast, if an error has occurred (YES in step S704), the first master controller 110 waits until the error is resolved.

Step S703 corresponds to step S502 described above with reference to FIGS. 5A and 5B, and step S705 corresponds to step S505 described above with reference to FIGS. 5A and 5B. Specifically, when the first master controller 110 receives a cooperative command without receiving an independent command, the first master controller 110 provides a notification about the image formation settings corresponding to the cooperative command in step S703 and transmits a preparation command corresponding to the cooperative command in step S705.

Subsequently, the first master controller 110 determines in step S706 whether or not a completion notification is received from the second master controller 210. If a completion notification is received (YES in step S706 (i.e., this step corresponds to step S515 described above with reference to FIGS. 5A and 5B)), the first master controller 110 notifies the first slave controller 120 of the preparation command for performing image formation preparation in the first image forming section 10 in step S707. Step S707 corresponds to step S516 described above with reference to FIGS. 5A and 5B. In contrast, if a completion notification is not received (NO in step S706), the first master controller 110 waits until it receives the completion notification.

Subsequently, the first master controller 110 determines in step S708 whether or not a completion notification indicating that the image forming process is completed is acquired from the first slave controller 120. Then, if a completion notification is acquired (YES in step S708), the first master controller 110 transmits the completion notification indicating that the image forming process is completed to the second master controller 210 in step S709. Step S709 corresponds to step S525 described above with reference to FIGS. 5A and 5B.

Subsequently, the first master controller 110 determines in step S710 whether or not information indicating the reception of the completion notification is received from the second master controller 210. Then, if information indicating the reception of the completion notification is received (YES in step S710 (i.e., this step corresponds to step S528 described above with reference to FIGS. 5A and 5B)), the first master controller 110 ends the image forming operation in step S711. In contrast, if information indicating the reception of the completion notification is not received (NO in step S710), the first master controller 110 waits until it receives the information.

On the other hand, if an independent command is received (YES in step S701), the first master controller 110 determines in step S712 whether or not a cooperative command is received from, for example, the terminal apparatus 8. If a cooperative command is received (YES in step S712), the first master controller 110 notifies the first slave controller 120 of the image formation settings corresponding to the independent command in step S714 since the cooperative command is received after the independent command. Then, the first master controller 110 determines in step S715 whether or not an error has occurred. If an error has occurred (YES in step S715), the first master controller 110 waits until the error is resolved. In contrast, if an error has not occurred (NO in step S715), the first master controller 110 notifies the first slave controller 120 of the preparation command, corresponding to the independent command, for performing image formation preparation in the first image forming section 10 in step S716. Steps S714, S715, and S716 correspond to steps S603, S605, and S606 described above with reference to FIGS. 6A and 6B.

Subsequently, the first master controller 110 determines in step S717 whether or not a completion notification indicating that the image forming process corresponding to the independent command is completed is acquired from the first slave controller 120. If a completion notification is not received (NO in step S717), the first master controller 110 waits until it receives the completion notification. In contrast, if a completion notification is acquired (YES in step S717 (i.e., this step corresponds to step S613 described above with reference to FIGS. 6A and 6B)), the first master controller 110 transmits, to the second master controller 210 in step S718, a preparation command, corresponding to the cooperative command, for performing image formation preparation in the second image forming section 20. Step S718 corresponds to step S614 described above with reference to FIGS. 6A and 6B.

Subsequently, the first master controller 110 determines in step S719 whether or not a completion notification corresponding to the cooperative command is received from the second master controller 210. If a completion notification is received (YES in step S719 (i.e., this step corresponds to step S515 in FIGS. 6A and 6B)), the first master controller 110 notifies the first slave controller 120 of the preparation command, corresponding to the cooperative command, for performing image formation preparation in the first image forming section 10 in step S720. Step S720 corresponds to step S516 in FIGS. 5A and 5B. In contrast, if a completion notification is not received (NO in step S719), the first master controller 110 waits until it receives the completion notification.

Subsequently, the first master controller 110 determines in step S721 whether or not a completion notification indicating that the image forming process is completed is acquired from the first slave controller 120. If a completion notification is acquired (YES in step S721 (i.e., this step corresponds to step S524 in FIGS. 6A and 6B)), the first master controller 110 transmits the completion notification indicating that the image forming process is completed to the second master controller 210 in step S722. Step S722 corresponds to step S525 in FIGS. 6A and 6B.

Subsequently, the first master controller 110 determines in step S723 whether or not information indicating the reception of the completion notification is received from the second master controller 210. Then, if information indicating the reception of the completion notification is received (YES in step S723 (i.e., this step corresponds to step S528 in FIGS. 6A and 6B)), the first master controller 110 ends the image forming operation in step S711. In contrast, if information indicating the reception of the completion notification is not received (NO in step S723), the first master controller 110 waits until it receives the information.

On the other hand, if a cooperative command is not received in step S712 (NO in step S712), the first master controller 110 notifies the first slave controller 120 of the image formation settings corresponding to the independent command in step S724. Then, the first master controller 110 determines in step S725 whether or not an error has occurred. If an error has occurred (YES in step S725), the first master controller 110 waits until the error is resolved. In contrast, if an error has not occurred (NO in step S725), the first master controller 110 notifies the first slave controller 120 of the preparation command for performing image formation preparation in the first image forming section 10 in step S726. Subsequently, the first master controller 110 determines in step S727 whether or not a completion notification indicating that the image forming process is completed is acquired from the first slave controller 120. If a completion notification is not received (NO in step S727), the first master controller 110 waits until it receives the completion notification. In contrast, if a completion notification is acquired (YES in step S727), the first master controller 110 ends the image forming operation in step S711.

The above-described example corresponds to a case where, after an independent command is received in step S601, a cooperative command is received in step S602 before the first slave controller 120 is notified of the image formation settings corresponding to the independent command in step S603. Alternatively, even in a case where the cooperative command is received after the notification about the image formation settings corresponding to the independent command is provided in step S603 and before the acquisition of the completion notification in step S613, the transmission of the preparation command, corresponding to the received cooperative command, for performing image formation preparation in the second image forming section 20 may be put on hold until the completion notification corresponding to the independent command is acquired in step S613.

Specifically, in the flowcharts illustrating the example of the process performed by the first master controller 110 described above with reference to FIGS. 7 and 8, the first master controller 110 determines in step S712 whether or not a cooperative command is received after determining that an independent command is received (YES in step S701). Alternatively, the determination in step S712 may be performed at a different timing. Specifically, for example, the first master controller 110 may determine that an independent command is received (YES in step S701), may subsequently notify the first slave controller 120 of the image formation settings corresponding to the independent command in step S724, may then notify the first slave controller 120 of the preparation command for performing image formation preparation in the first image forming section 10 in step S726 if an error has not occurred (NO in step S725), may subsequently acquire a completion notification indicating that the image forming process is completed from the first slave controller 120 (YES in step S727), and may then determine whether or not a cooperative command is received. If a cooperative command is received, the first master controller 110 may perform the steps from step S718 and onward. If a cooperative command is not received, the first master controller 110 may end the image forming operation in step S711.

A process performed by the second master controller 210 according to the first exemplary embodiment will be described below with reference to a flowchart.

Figure 9:
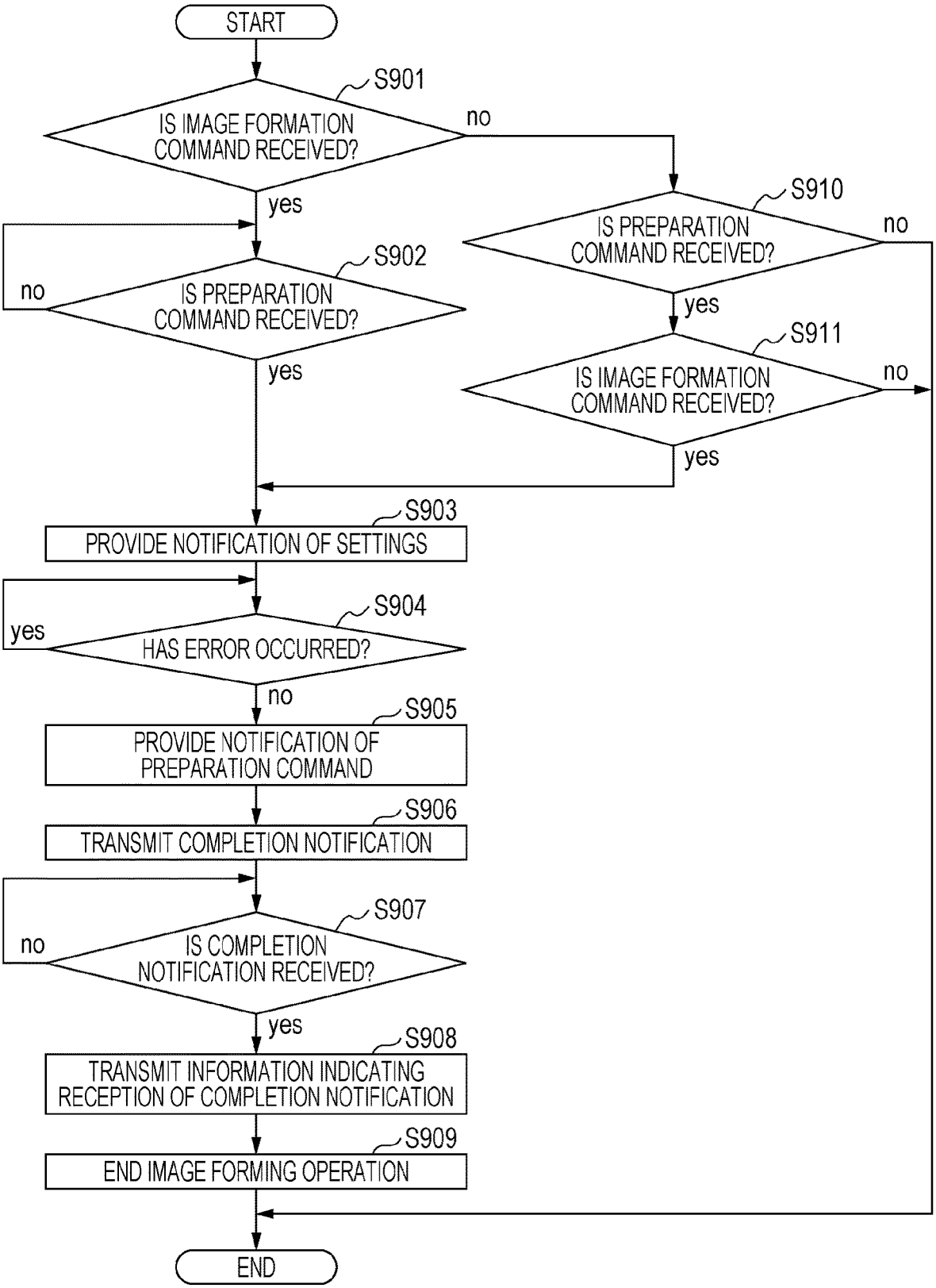
FIG. 9 is a flowchart illustrating an example of a process performed by a second master controller according to the first exemplary embodiment.

FIG. 9 is a flowchart illustrating an example of the process performed by the second master controller 210 according to the first exemplary embodiment. The second master controller 210 repeatedly performs this process at every predetermined fixed time period (e.g., 1 millisecond).

In step S901, the second master controller 210 determines whether or not an image formation command is received from, for example, the terminal apparatus 8. If an image formation command is received (YES in step S901 (i.e., this step corresponds to step S507 described above with reference to FIGS. 5A and 5B or step S600 described above with reference to FIGS. 6A and 6B)), the second master controller 210 determines in step S902 whether or not a preparation command is received from the first master controller 110. If a preparation command is received (YES in step S902 (i.e., this step corresponds to step S615 described above with reference to FIGS. 6A and 6B)), the second master controller 210 notifies the second slave controller 220 of the designated image formation settings in step S903. Step S903 corresponds to step S508 in FIGS. 6A and 6B.

Subsequently, in step S904, the second master controller 210 determines whether or not an error has occurred in the second image forming section 20. Step S904 corresponds to step S510 in FIGS. 6A and 6B. If an error has occurred (YES in step S904), the second master controller 210 waits until the error is resolved. In contrast, if an error has not occurred (NO in step S904), the second master controller 210 notifies the second slave controller 220 of the preparation command for performing image formation preparation in the second image forming section 20 in step S905. Step S905 corresponds to step S511 in FIGS. 6A and 6B. Then, the second master controller 210 transmits a completion notification to the first master controller 110 in step S906. Step S906 corresponds to step S514 in FIGS. 6A and 6B.

Subsequently, the second master controller 210 determines in step S907 whether or not a completion notification indicating that the image forming process is completed is received from the first master controller 110. Then, if a completion notification is not received (NO in step S907), the second master controller 210 waits until it receives the completion notification. In contrast, if a completion notification is received (YES in step S907 (i.e., this step corresponds to step S526 in FIGS. 6A and 6B)), the second master controller 210 transmits information indicating the reception of the completion notification to the first master controller 110 in step S908. Step S908 corresponds to step S527 in FIGS. 6A and 6B. Then, the second master controller 210 ends the image forming operation in step S909.

On the other hand, if an image formation command is not received in step S901 (NO in step S901), the second master controller 210 determines in step S910 whether or not a preparation command is received from the first master controller 110. If a preparation command is received (YES in step S910), the second master controller 210 determines in step S911 whether or not an image formation command is received from, for example, the terminal apparatus 8. If an image formation command is received (YES in step S911), the second master controller 210 performs step S903 and onward. In contrast, if an image formation command is not received (NO in step S911), the second master controller 210 ends the process.

In the exemplary embodiment above, the functions of the first controller 100 are executed by the CPU 111 of the first master controller 110 and the CPU 121 of the first slave controller 120 operating in cooperation with each other. Alternatively, the configuration is not particularly limited to that described above. For example, the functions of the first controller 100 may be realized by a single processor, or may be realized by using three or more processors. Likewise, in the exemplary embodiment above, the functions of the second controller 200 are executed by the CPU 211 of the second master controller 210 and the CPU 221 of the second slave controller 220 operating in cooperation with each other. Alternatively, the configuration is not particularly limited to that described above. For example, the functions of the second controller 200 may be realized by a single processor, or may be realized by using three or more processors. In the exemplary embodiment above, the term "processor" refers to hardware in a broad sense. Examples of the processor include general processors (e.g., CPU: Central Processing Unit), and dedicated processors (e.g., GPU: Graphics Processing Unit, ASIC: Application Integrated Circuit, FPGA: Field Programmable Gate Array, and programmable logic device).

The image forming apparatus 2 described above includes the CPU 111 and the CPU 121 as an example of a first processor configured to control the sheet transporter 40 serving as an example of a transporter that transports a sheet and the first image forming section 10 that forms an image on the sheet transported by the sheet transporter 40, and the CPU 211 and the CPU 221 as an example of a second processor configured to control the second image forming section 20 that forms an image on the sheet transported by the sheet transporter 40.

When the first processor and the second processor receive, from an external source, a cooperative command as an image formation command given for forming images at the first image forming section 10 and the second image forming section 20, the first processor transmits a preparation command for performing image formation preparation in the second image forming section 20 to the second processor (step S505), the second processor, when receiving the preparation command, performs the image formation preparation in the second image forming section 20 (step S513) and transmits a completion notification to the first processor upon completion of the image formation preparation (step S514), and the first processor, after receiving the completion notification (step S515), executes an image forming process involving causing the sheet transporter 40 to transport a sheet and causing the first image forming section 10 to form an image.

Furthermore, before transmitting the preparation command to the second processor, if the first processor receives a cooperative command after receiving an independent command as an image formation command given for forming an image at the first image forming section 10 but not for forming an image at the second image forming section 20, the first processor transmits the preparation command corresponding to the cooperative command to the second processor (step S614) upon completion of an image forming process corresponding to the independent command.

Accordingly, the first processor transmits the preparation command corresponding to the cooperative command to the second processor upon completion of the image forming process corresponding to the independent command, so that image forming processes corresponding to the same image formation command may be executed on a single sheet by the first image forming section 10 and the second image forming section 20.

The first processor may analyze an image formation command received from an external source so as to determine whether the image formation command is an independent command or a cooperative command. For example, the first processor determines that an image formation command is an independent command if the image formation command contains information indicating that it is an independent command. Accordingly, the first processor may ascertain that the image formation command received from the external source is an independent command.

The programs executed by the CPU 111 of the first master controller 110, the CPU 121 of the first slave controller 120, the CPU 211 of the second master controller 210, and the CPU 221 of the second slave controller 220 may each be provided by being stored in a computer-readable storage medium, such as a magnetic storage medium (e.g., magnetic tape or a magnetic disk), an optical storage medium (e.g., an optical disk), a magneto-optical storage medium, or a semiconductor memory, or may each be downloaded by using a communication unit, such as the Internet.

A program according to an exemplary embodiment of the disclosure causes the first processor to execute a function. The first processor is configured to control the sheet transporter 40 that transports a sheet and the first image forming section 10 that forms an image on the sheet transported by the sheet transporter 40. The second processor is configured to control the second image forming section 20 that forms an image on the sheet transported by the sheet transporter 40. The function of the first processor includes transmitting a preparation command for performing image formation preparation in the second image forming section 20 to the second processor when the first processor and the second processor receive, from an external source, a cooperative command as an image formation command given for forming images at the first image forming section 10 and the second image forming section 20. Furthermore, the program according to the exemplary embodiment of the disclosure also causes the second processor to execute a function and the first processor to execute a function. The function of the second processor includes performing image formation preparation in the second image forming section 20 when the second processor receives the preparation command, and transmitting a completion notification to the first processor upon completion of the image formation preparation. The function of the first processor includes executing an image forming process involving causing the sheet transporter 40 to transport a sheet and causing the first image forming section 10 to form an image after the first processor receives the completion notification.

Moreover, in the program according to the exemplary embodiment of the disclosure, if the first processor, before transmitting the preparation command to the second processor, receives the cooperative command after receiving an independent command as an image formation command given for forming an image at the first image forming section 10 but not for forming an image at the second image forming section 20, the first processor is caused to transmit the preparation command corresponding to the cooperative command to the second processor upon completion of an image forming process corresponding to the independent command.

Second Exemplary Embodiment

In a second exemplary embodiment, processes performed by the first master controller 110 and the second master controller 210 are different from those in the first exemplary embodiment. Detailed descriptions of identical features between the first exemplary embodiment and the second exemplary embodiment will be omitted, and different features will be described below.

When the first master controller 110 according to the second exemplary embodiment receives an independent command and subsequently receives a cooperative command, the first master controller 110 transmits a non-preparation command, corresponding to the independent command, for not performing image formation preparation in the second image forming section 20 to the second master controller 210, and also transmits a preparation command corresponding to the cooperative command to the second master controller 210.

When receiving the non-preparation command, the second master controller 210 according to the second exemplary embodiment sets the second image forming section 20 in an inactive stopped state and maintains the stopped state until the second master controller 210 receives information indicating that an image forming process corresponding to the independent command is completed from the first master controller 110. Then, after receiving the information indicating that the image forming process corresponding to the independent command is completed from the first master controller 110, the second master controller 210 performs image formation preparation, corresponding to the cooperative command, in the second image forming section 20 and transmits a completion notification to the first master controller 110 upon completion of the image formation preparation.

Then, after receiving the completion notification, the first master controller 110 according to the second exemplary embodiment executes an image forming process corresponding to the cooperative command.

Figure 10A:
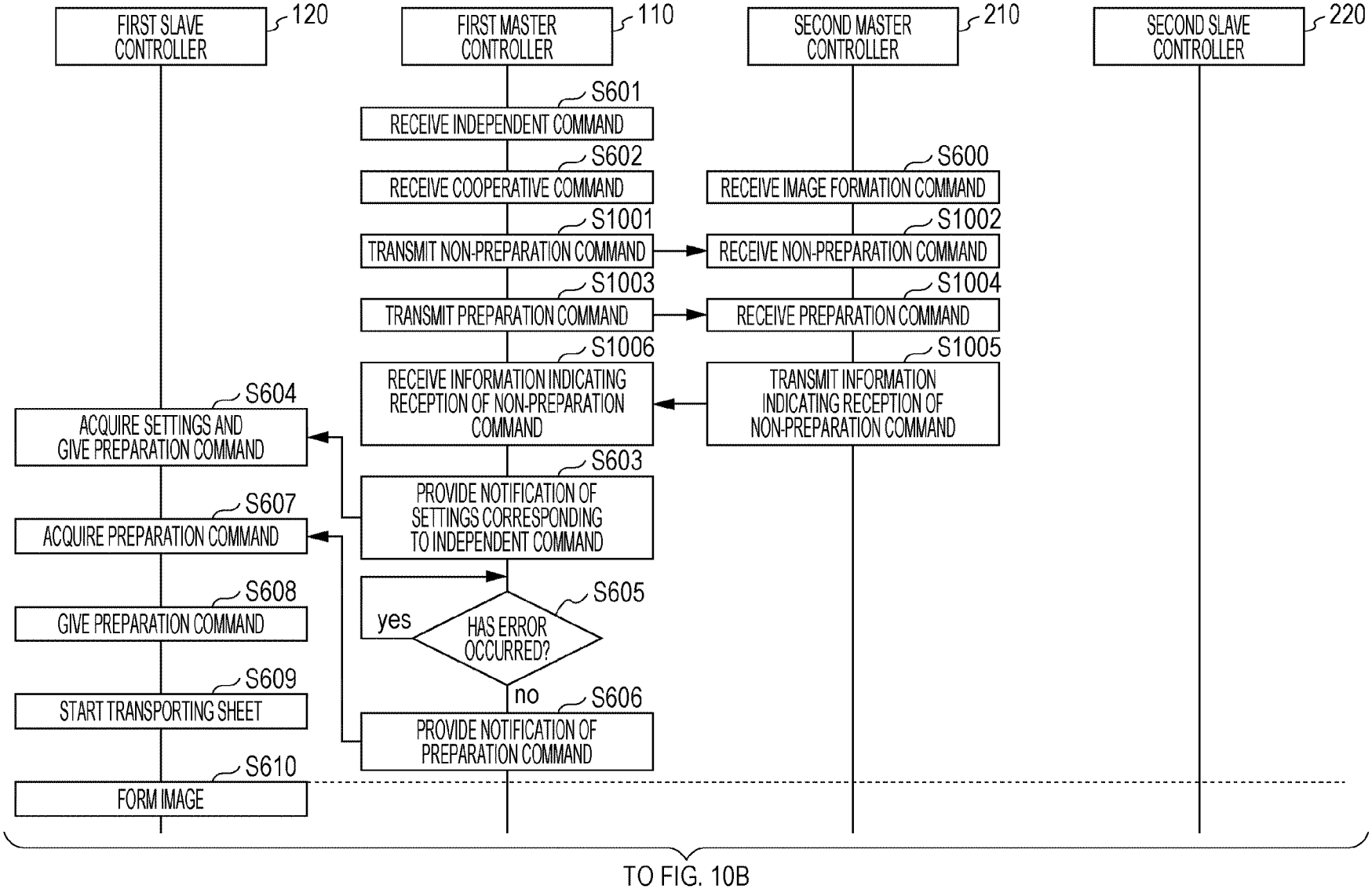
FIGS. 10A and 10B illustrate an example of a process performed by the first controller and the second controller according to a second exemplary embodiment.
Figure 10B:
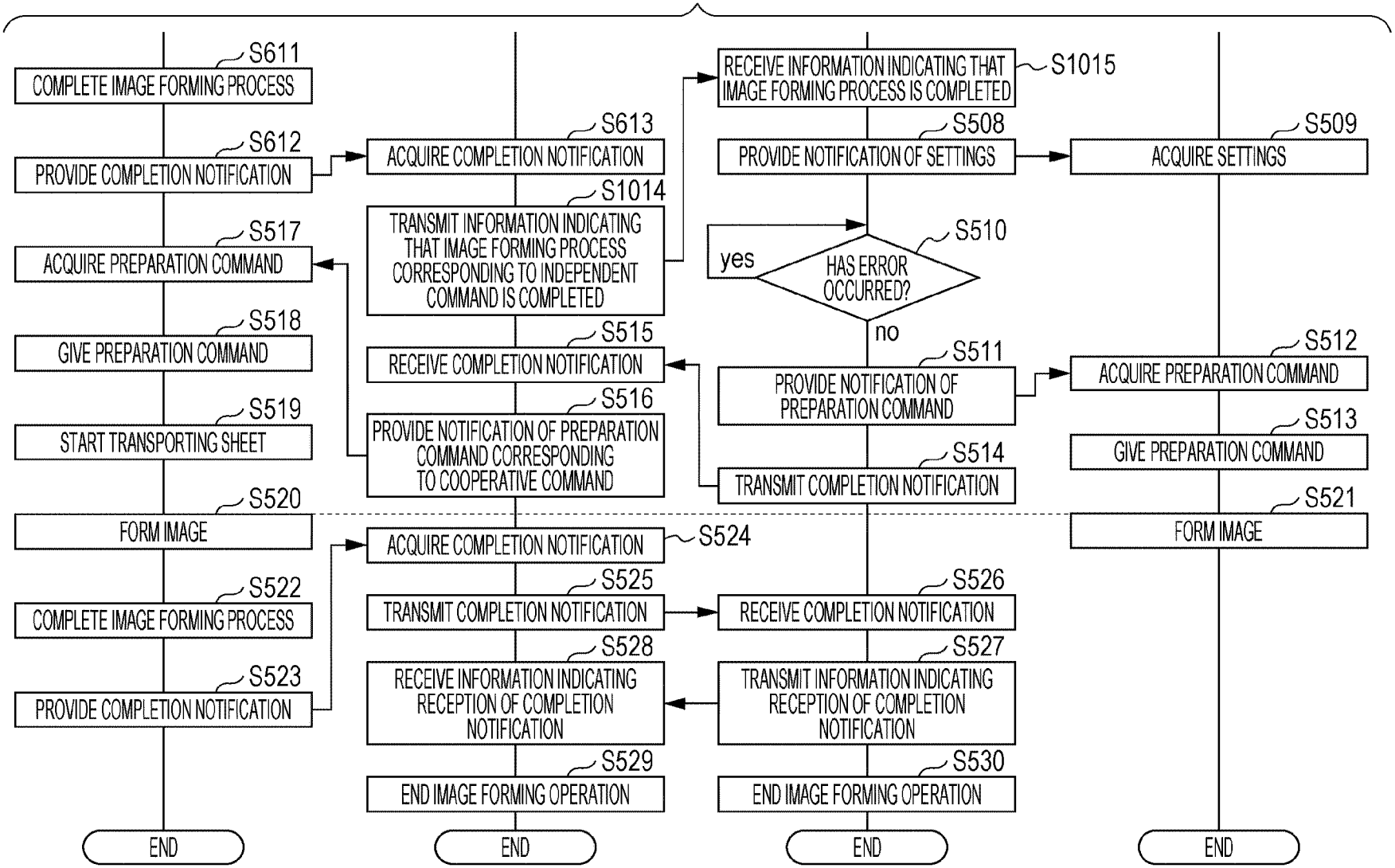

FIGS. 10A and 10B illustrate an example of a process performed by the first controller 100 and the second controller 200 according to the second exemplary embodiment. The example of the process shown in FIGS. 10A and 10B corresponds to a case where the first controller 100 receives an independent command and subsequently receives a cooperative command. In FIGS. 10A and 10B, steps identical to the steps shown in FIGS. 6A and 6B are given the same reference signs, and descriptions thereof will be omitted.

In detail, when the first master controller 110 receives an independent command in step S601 and subsequently receives a cooperative command in step S602, the first master controller 110 transmits, to the second master controller 210 in step S1001, a non-preparation command, corresponding to the independent command, for not performing image formation preparation in the second image forming section 20. In step S1002, the second master controller 210 receives the non-preparation command, corresponding to the independent command, transmitted from the first master controller 110.

In step S1003, the first master controller 110 transmits a preparation command corresponding to the cooperative command to the second master controller 210. In step S1004, the second master controller 210 receives the preparation command, corresponding to the cooperative command, transmitted from the first master controller 110.

Subsequently, in step S1005, the second master controller 210 transmits a reception notification indicating the reception of the non-preparation command to the first master controller 110. In step S1006, the first master controller 110 receives the reception notification indicating the reception of the non-preparation command transmitted from the second master controller 210.

Then, in order to perform an image forming process corresponding to the independent command, the first master controller 110 and the first slave controller 120 perform step S603 to step S613, similarly to the first exemplary embodiment.

After acquiring a completion notification in step S613, the first master controller 110 transmits information indicating that the image forming process corresponding to the independent command is completed to the second master controller 210 in step S1014.

In step S1015, the second master controller 210 receives the information indicating that the image forming process is completed from the first master controller 110.

Subsequently, in order to perform an image forming process corresponding to the cooperative command, the first master controller 110, the first slave controller 120, the second master controller 210, and the second slave controller 220 perform step S508 and onward, similarly to the first exemplary embodiment.

A process performed by the first master controller 110 according to the second exemplary embodiment will be described below with reference to flowcharts.

Figure 11:
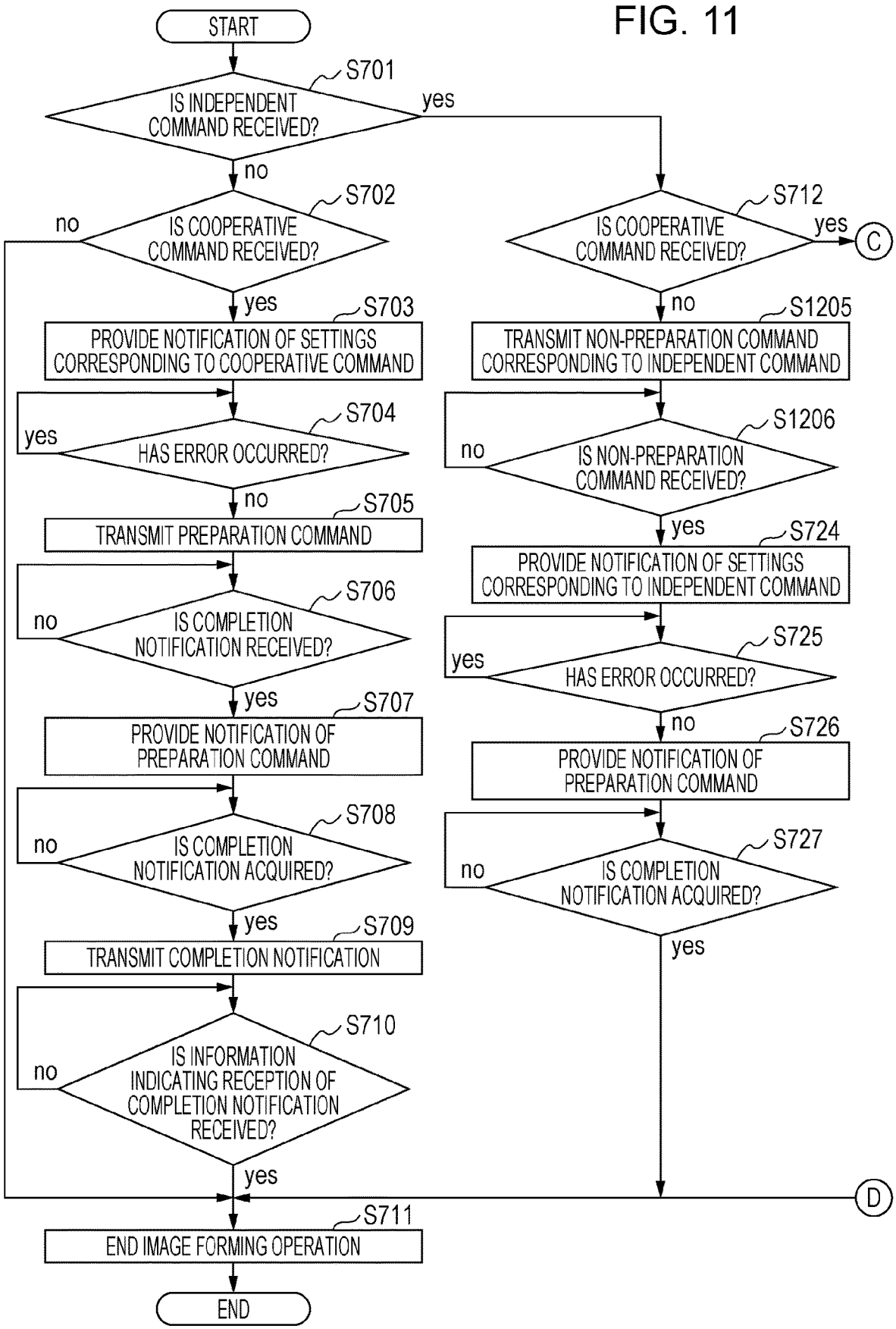
FIG. 11 is a flowchart illustrating the example of the process performed by the first master controller according to the second exemplary embodiment.
Figure 12:
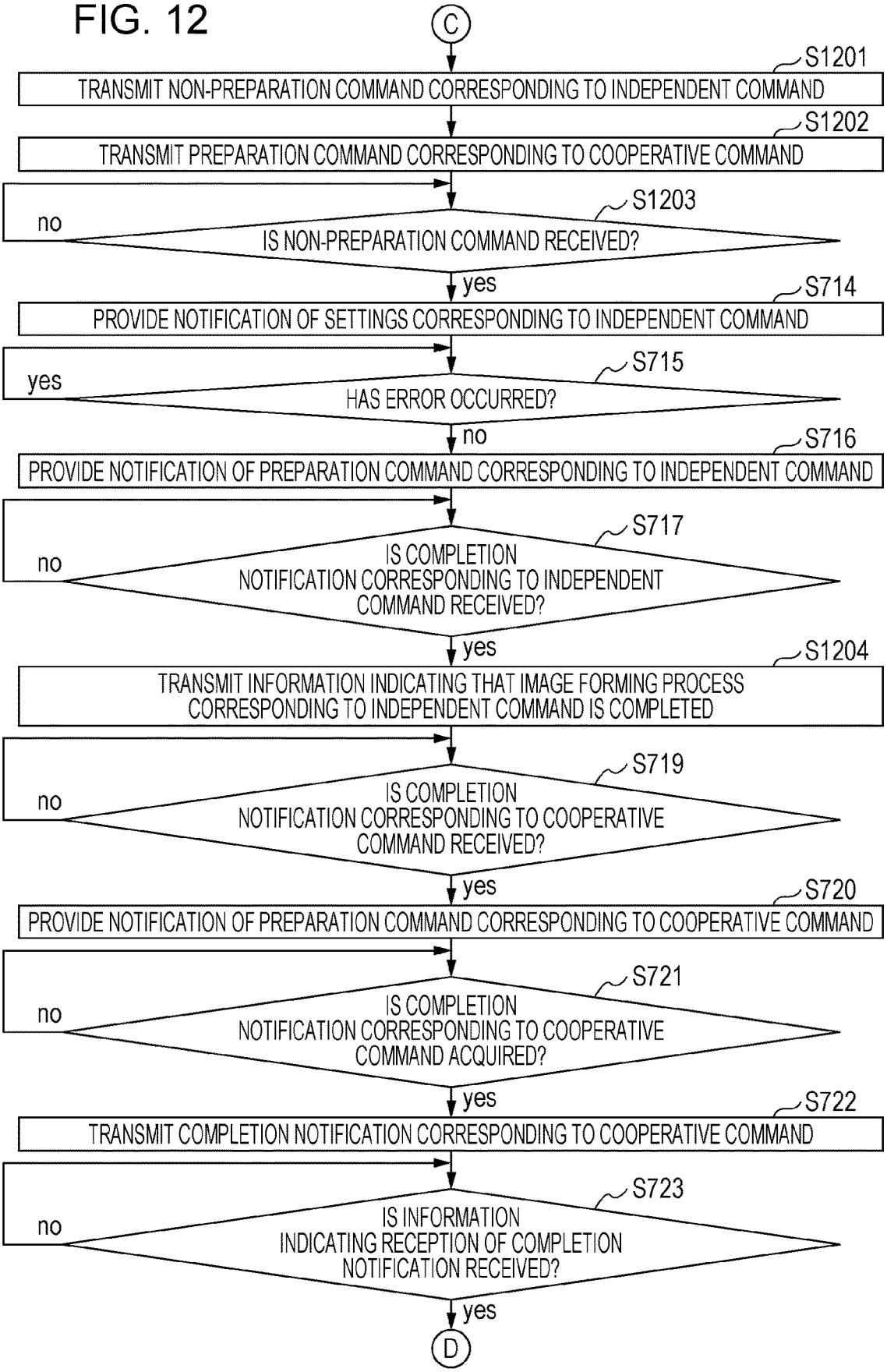
FIG. 12 is a flowchart illustrating the example of the process performed by the first master controller according to the second exemplary embodiment.

FIGS. 11 and 12 are flowcharts illustrating an example of the process performed by the first master controller 110 according to the second exemplary embodiment. The first master controller 110 repeatedly performs this process at every predetermined fixed time period (e.g., 1 millisecond). In steps 11 and 12, steps identical to the steps shown in FIGS. 7 and 8 are given the same reference signs, and descriptions thereof will be omitted.

If the first master controller 110 according to the second exemplary embodiment has received a cooperative command in step S712 (YES in step S712), the first master controller 110 transmits a non-preparation command corresponding to the independent command to the second master controller 210 in step S1201 since the first master controller 110 has received the cooperative command after the independent command, as shown in FIG. 12. Then, in step S1202, the first master controller 110 transmits a preparation command corresponding to the cooperative command to the second master controller 210. Steps S1201 and S1202 correspond to steps S1001 and S1003 described above with reference to FIGS. 10A and 10B.

Subsequently, the first master controller 110 determines in step S1203 whether or not a non-preparation command is received from the second master controller 210. If a non-preparation command is not received (NO in step S1203), the first master controller 110 waits until it receives the non-preparation command. In contrast, if a non-preparation command is received (YES in step S1203 (i.e., this step corresponds to step S1006 described above with reference to FIGS. 10A and 10B)), the first master controller 110 performs steps S714, S715, S716, and S717.

If a completion notification is acquired in step S717 (YES in step S717 (i.e., this step corresponds to step S613 in FIGS. 10A and 10B)), the first master controller 110 transmits information indicating that an image forming process corresponding to the independent command is completed to the second master controller 210 in step S1204. Step S1204 corresponds to step S1014 described above with reference to FIGS. 10A and 10B.

The first master controller 110 then performs step S719 and onward.

On the other hand, if a cooperative command is not received in step S712 (NO in step S712), the first master controller 110 transmits a non-preparation command corresponding to the independent command in step S1205. Then, in step S1206, the first master controller 110 determines whether or not a non-preparation command is received from the second master controller 210. If a non-preparation command is not received (NO in step S1206), the first master controller 110 waits until it receives the non-preparation command. In contrast, if a non-preparation command is received (YES in step S1206), the first master controller 110 performs step S724 and onward.

The above-described example corresponds to a case where the first master controller 110 receives an independent command in step S601 and subsequently receives a cooperative command in step S602 before transmitting a non-preparation command to the second master controller 210 in step S1001. Alternatively, even in a case where the cooperative command is received after the transmission of the non-preparation command to the second master controller 210 in step S1001 and before the acquisition of the completion notification in step S613, the preparation command, corresponding to the received cooperative command, may be transmitted to the second master controller 210.

Specifically, in the flowcharts illustrating the example of the process performed by the first master controller 110 described above with reference to FIGS. 11 and 12, the first master controller 110 determines in step S712 whether or not a cooperative command is received after determining that an independent command is received (YES in step S701). Alternatively, the determination in step S712 may be performed at a different timing. For example, the first master controller 110 may determine that an independent command is received (YES in step S701), may subsequently transmit a non-preparation command corresponding to the independent command to the second master controller 210 in step S1205, may then receive the non-preparation command from the second master controller 210 (YES in step S1206), may notify the first slave controller 120 of the preparation command for performing image formation preparation in the first image forming section 10 in step S726 if an error has not occurred (NO in step S725), and may subsequently determine whether or not a cooperative command is received until a completion notification indicating that an image forming process is completed is received from the first slave controller 120 (YES in step S727). If the first master controller 110 has received a cooperative command, the first master controller 110 may transmit a preparation command corresponding to the cooperative command and acquire a completion notification indicating that an image forming process is completed (YES in step S727), and subsequently perform step S1204 and onward. If a cooperative command is not received, the first master controller 110 may end the image forming operation in step S711.

A process performed by the second master controller 210 according to the second exemplary embodiment will be described below with reference to a flowchart.

Figure 13A:
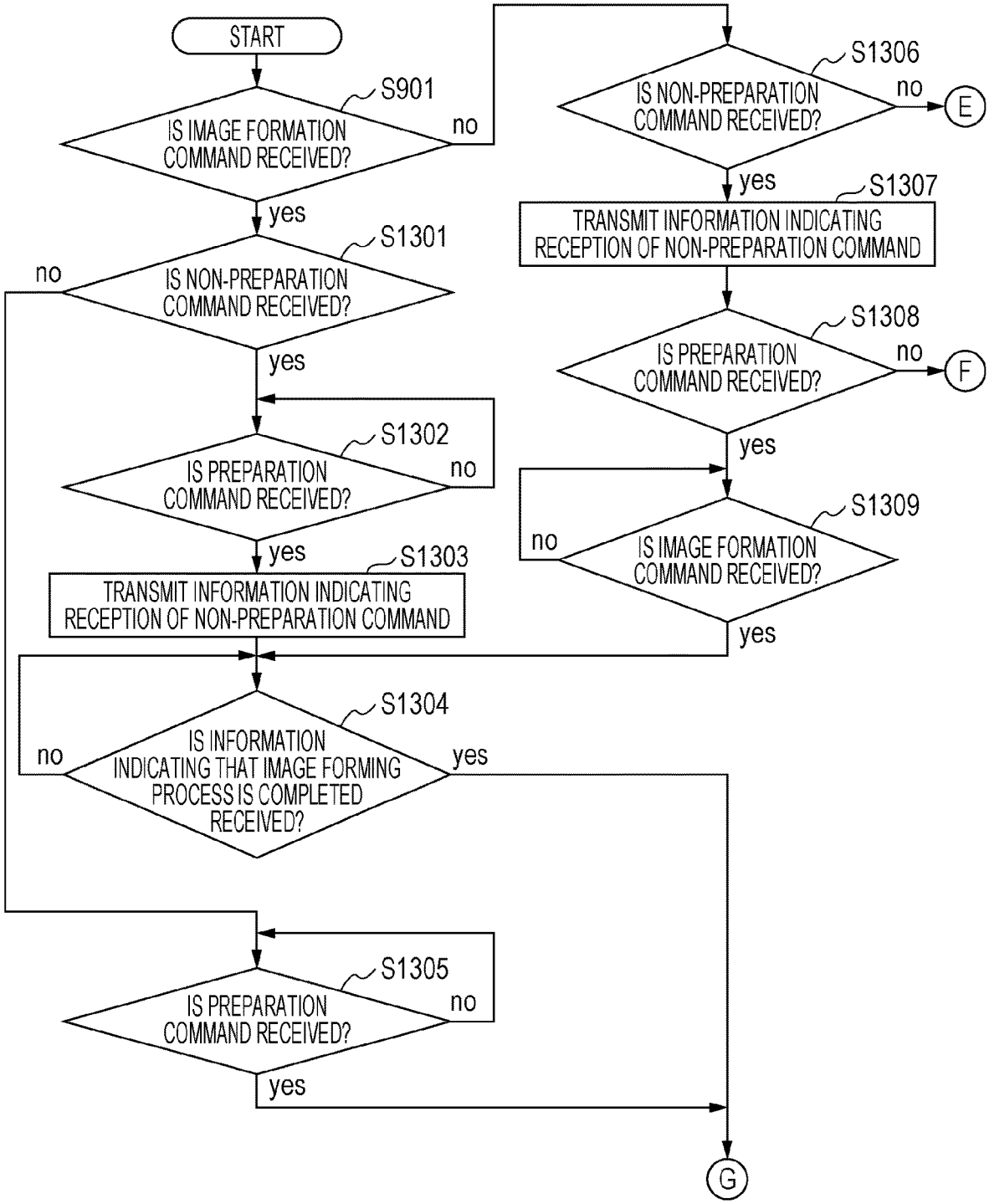
FIGS. 13A and 13B are a flowchart illustrating the example of the process performed by the second master controller according to the second exemplary embodiment.
Figure 13B:
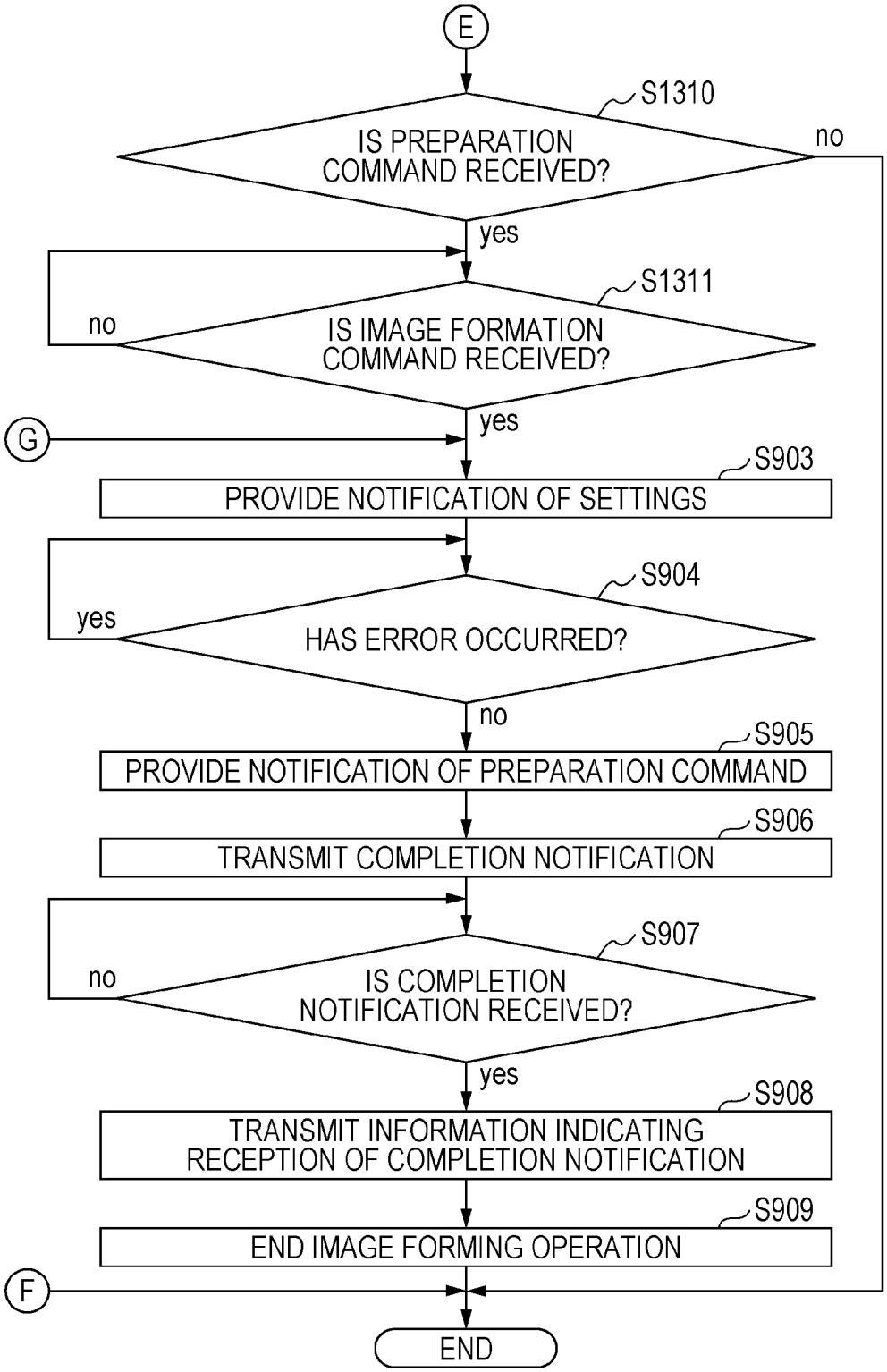

FIGS. 13A and 13B are a flowchart illustrating an example of the process performed by the second master controller 210 according to the second exemplary embodiment. The second master controller 210 repeatedly performs this process at every predetermined fixed time period (e.g., 1 millisecond). In FIGS. 13A and 13B, steps identical to the steps shown in FIG. 9 are given the same reference signs, and descriptions thereof will be omitted.

If an image formation command is received (YES in step S901), the second master controller 210 determines in step S1301 whether or not a non-preparation command is received from the first master controller 110. If a non-preparation command is received (YES in step S1301 (i.e., this step corresponds to step S1002 described above with reference to FIGS. 10A and 10B)), the second master controller 210 determines in step S1302 whether or not a preparation command is received from the first master controller 110. If a preparation command is received (YES in step S1302 (i.e., this step corresponds to step S1004 described above with reference to FIGS. 10A and 10B)), the second master controller 210 transmits information indicating that the non-preparation command is received to the first master controller 110 in step S1303. Step S1302 corresponds to step S1005 described above with reference to FIGS. 10A and 10B. Subsequently, the second master controller 210 determines in step S1304 whether or not information indicating that an image forming process is completed is received from the first master controller 110. If information indicating that the image forming process is completed is received (YES in step S1304 (i.e., this step corresponds to step S1015 described above with reference to FIGS. 10A and 10B)), the second master controller 210 performs step S903 and onward.

If a non-preparation command is not received in step S1301 (NO in step S1301), the second master controller 210 determines in step S1305 whether or not a preparation command is received from the first master controller 110. If a preparation command is not received (NO in step S1305), the second master controller 210 waits until it receives the preparation command. In contrast, if a preparation command is received (YES in step S1305), the second master controller 210 performs step S903 and onward.

If an image formation command is not received in step S901 (NO in step S901), the second master controller 210 determines in step S1306 whether or not a non-preparation command is received from the first master controller 110. If a non-preparation command is received (YES in step S1306), the second master controller 210 transmits information indicating the reception of the non-preparation command to the first master controller 110 in step S1307. Then, the second master controller 210 determines in step S1308 whether or not a preparation command is received from the first master controller 110. If a preparation command is received (YES in step S1308), the second master controller 210 determines in step S1309 whether or not an image formation command is received from an external source. If an image formation command is not received (NO in step S1309), the second master controller 210 waits until it receives the image formation command. In contrast, if an image formation command is received (YES in step S1309), the second master controller 210 performs step S1304 and onward. If a preparation command is not received (NO in step S1308), the second master controller 210 ends the process.

On the other hand, if a non-preparation command is not received (NO in step S1306), the second master controller 210 determines in step S1310 whether or not a preparation command is received. If a preparation command is received (YES in step S1310), the second master controller 210 determines in step S1311 whether or not an image formation command is received from an external source. If an image formation command is not received (NO in step S1311), the second master controller 210 waits until it receives the image formation command. In contrast, if an image formation command is received (YES in step S1311), the second master controller 210 performs step S903 and onward. If a preparation command is not received (NO in step S1310), the second master controller 210 ends the process.

The image forming apparatus 2 according to the second exemplary embodiment described above includes the CPU 111 and the CPU 121 as an example of a first processor configured to control the sheet transporter 40 serving as an example of a transporter that transports a sheet and the first image forming section 10 that forms an image on the sheet transported by the sheet transporter 40, and the CPU 211 and the CPU 221 as an example of a second processor configured to control the second image forming section 20 that forms an image on the sheet transported by the sheet transporter 40.

When the first processor and the second processor receive, from an external source, a cooperative command as an image formation command given for forming images at the first image forming section 10 and the second image forming section 20, the first processor transmits a preparation command for performing image formation preparation in the second image forming section 20 to the second processor (step S505), the second processor, when receiving the preparation command, performs the image formation preparation in the second image forming section 20 (step S513) and transmits a completion notification to the first processor upon completion of the image formation preparation (step S514), and the first processor, after receiving the completion notification (step S515), executes an image forming process involving causing the sheet transporter 40 to transport a sheet and causing the first image forming section 10 to form an image.

If the first processor receives an independent command as an image formation command given for forming an image at the first image forming section 10 but not for forming an image at the second image forming section 20 and subsequently receives the cooperative command, the first processor transmits, to the second processor, a non-preparation command corresponding to the independent command given for forming an image at the first image forming section 10 but not for forming an image at the second image forming section 20 (step S1001), receives a reception notification corresponding to the non-preparation command from the second processor (step S1006), and subsequently executes an image forming process corresponding to the independent command.

In this manner, the first processor transmits the non-preparation command to the second processor so that the second processor may be informed that an image is not to be formed at the second image forming section 20, whereby image forming processes corresponding to the same image formation command may be executed on a single sheet by the first image forming section 10 and the second image forming section 20.

A program according to an exemplary embodiment of the disclosure causes the first processor to execute a function. The first processor is configured to control the sheet transporter 40 that transports a sheet and the first image forming section 10 that forms an image on the sheet transported by the sheet transporter 40. The second processor is configured to control the second image forming section 20 that forms an image on the sheet transported by the sheet transporter 40. The function of the first processor includes transmitting a preparation command for performing image formation preparation in the second image forming section 20 to the second processor when the first processor and the second processor receive, from an external source, a cooperative command as an image formation command given for forming images at the first image forming section 10 and the second image forming section 20. Furthermore, the program according to the exemplary embodiment of the disclosure also causes the second processor to execute a function and the first processor to execute a function. The function of the second processor includes performing image formation preparation in the second image forming section 20 when the second processor receives the preparation command, and transmitting a completion notification to the first processor when the image formation preparation is completed. The function of the first processor includes executing an image forming process involving causing the sheet transporter 40 to transport a sheet and causing the first image forming section 10 to form an image after the first processor receives the completion notification.

Moreover, in the program according to the exemplary embodiment of the disclosure, if the first processor receives an independent command as an image formation command given for forming an image at the first image forming section 10 but not for forming an image at the second image forming section 20 and subsequently receives a cooperative command, the first processor is caused to transmit, to the second processor, a non-preparation command corresponding to the independent command given for forming an image at the first image forming section 10 but not for forming an image at the second image forming section 20 and receive a reception notification corresponding to the non-preparation command from the second processor, and subsequently execute an image forming process corresponding to the independent command.

From another standpoint, a program according to an exemplary embodiment of the disclosure causes a second processor to execute a function when a first processor and the second processor receive, from an external source, a cooperative command as an image formation command given for forming images at the first image forming section 10 and the second image forming section 20. The first processor is configured to control the sheet transporter 40 that transports a sheet and the first image forming section 10 that forms an image on the sheet transported by the sheet transporter 40. The second processor is configured to control the second image forming section 20 that forms an image on the sheet transported by the sheet transporter 40. The function of the second processor includes performing image formation preparation in the second image forming section 20 after receiving, from the first processor, a preparation command, corresponding to the cooperative command, for performing image formation preparation in the second image forming section 20.

Furthermore, if the second processor receives a non-preparation command given for forming an image at the first image forming section 10 but not for forming an image at the second image forming section 20 before receiving the preparation command, the second processor is caused to transmit a reception notification indicating the reception of the non-preparation command to the first processor, receive a notification indicating that an image forming process corresponding to the non-preparation command is completed at the first image forming section 10, and subsequently perform the image formation preparation.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a first processor configured to control a transporter that transports a sheet and a first image forming section that forms an image on the sheet transported by the transporter; and a second processor configured to control a second image forming section that forms an image on the sheet transported by the transporter, wherein, when the first processor and the second processor receive, from an external source, a cooperative command as an image formation command given for forming images at the first image forming section and the second image forming section, the first processor is configured to transmit a preparation command for performing image formation preparation in the second image forming section to the second processor, the second processor, when receiving the preparation command, is configured to perform the image formation preparation in the second image forming section and transmit a completion notification to the first processor upon completion of the image formation preparation, and the first processor, after receiving the completion notification, is configured to execute an image forming process involving causing the transporter to transport the sheet and causing the first image forming section to form the image, and wherein, if the first processor receives an independent command as an image formation command given for forming an image at the first image forming section but not for forming an image at the second image forming section and subsequently receives the cooperative command, the first processor is configured to transmit the preparation command corresponding to the cooperative command to the second processor upon completion of an image forming process corresponding to the independent command.

2. The image forming apparatus according to claim 1, wherein the first processor is configured to analyze the image formation command received from the external source to determine whether the image formation command is the independent command or the cooperative command.

3. The image forming apparatus according to claim 1, wherein the first processor is configured to determine that the image formation command is the independent command if the image formation command contains information indicating that the image formation command is the independent command.

4. An image forming apparatus comprising:

a first processor configured to control a transporter that transports a sheet and a first image forming section that forms an image on the sheet transported by the transporter; and a second processor configured to control a second image forming section that forms an image on the sheet transported by the transporter, wherein, when the first processor and the second processor receive, from an external source, a cooperative command as an image formation command given for forming images at the first image forming section and the second image forming section, the first processor is configured to transmit a preparation command for performing image formation preparation in the second image forming section to the second processor, the second processor, when receiving the preparation command, is configured to perform the image formation preparation in the second image forming section and transmit a completion notification to the first processor upon completion of the image formation preparation, and the first processor, after receiving the completion notification, is configured to execute an image forming process involving causing the transporter to transport the sheet and causing the first image forming section to form the image, and wherein, if the first processor receives an independent command as an image formation command given for forming an image at the first image forming section but not for forming an image at the second image forming section and subsequently receives the cooperative command, the first processor is configured to transmit a non-preparation command, corresponding to the independent command, given for forming an image at the first image forming section but not for forming an image at the second image forming section to the second processor, receive a reception notification corresponding to the non-preparation command from the second processor, and subsequently execute the image forming process corresponding to the independent command.

5. The image forming apparatus according to claim 4, wherein, if the first processor receives the independent command and subsequently receives the cooperative command, the first processor is configured to transmit the non-preparation command corresponding to the independent command and subsequently transmit the preparation command corresponding to the cooperative command, and wherein the second processor is configured to transmit the reception notification corresponding to the non-preparation command, then receive a notification indicating that the image forming process corresponding to the independent command is completed from the first processor, and subsequently perform the image formation preparation.

6. An image forming apparatus comprising:

a first processor configured to control a transporter that transports a sheet and a first image forming section that forms an image on the sheet transported by the transporter; and a second processor configured to control a second image forming section that forms an image on the sheet transported by the transporter, wherein, when the second processor receives, from an external source, a cooperative command as an image formation command given for forming images at the first image forming section and the second image forming section, the second processor is configured to receive a preparation command, corresponding to the cooperative command, for performing image formation preparation in the second image forming section from the first processor, subsequently perform the image formation preparation in the second image forming section, and wherein, when the second processor receives a non-preparation command given for forming an image at the first image forming section but not for forming an image at the second image forming section before receiving the preparation command, the second processor is configured to transmit a reception notification indicating reception of the non-preparation command to the first processor, receive a notification indicating that an image forming process corresponding to the non-preparation command is completed at the first image forming section, and subsequently perform the image formation preparation.

7. The image forming apparatus according to claim 6, wherein, if the first processor receives, from the external source, an independent command as an image formation command given for forming an image at the first image forming section but not for forming an image at the second image forming section and subsequently receives the cooperative command, the first processor is configured to transmit the non-preparation command corresponding to the independent command to the second processor.

* * * * *